US005437956A

United States Patent [19]

Nakamura et al.

[11] Patent Number: 5,437,956

[45] Date of Patent: Aug. 1, 1995

[54] DYE FIXING ELEMENT

[75] Inventors: Yoshisada Nakamura; Hiroshi Arakatsu, both of Kanagawa, Japan

[73] Assignee: Fuji Photo Film Co., Ltd., Kanagawa, Japan

[21] Appl. No.: 241,411

[22] Filed: May 11, 1994

[30] Foreign Application Priority Data

May 12, 1993 [JP] Japan ..... 5-132379
May 24, 1993 [JP] Japan ..... 5-121673

[51] Int. Cl.[6] ..... G03C 8/24; G03C 8/52

[52] U.S. Cl. ..... 430/207; 430/203; 430/213; 430/215; 430/220; 430/950

[58] Field of Search ..... 430/203, 213, 220, 215, 430/207, 950

[56] References Cited

U.S. PATENT DOCUMENTS 4,868,088 9/1989 Aono et al. ..... 430/203
5,135,835 8/1992 Aono et al. ..... 430/203
5,225,313 7/1993 Aono et al. ..... 430/203
5,242,781 9/1993 Ohbayashi et al. ..... 430/203

*Primary Examiner*—Richard L. Schilling
*Attorney, Agent, or Firm*—Sughrue, Mion, Zinn, Macpeak & Seas

[57] ABSTRACT

A dye fixing element for use in an image formation system which is adapted to superimpose a light-sensitive element and a dye fixing element provided on separate supports upon each other so that diffusible dyes are transferred to said dye fixing element to form an image, which is characterized in that a matting agent is incorporated in either a layer nearer to said support than a dye fixing layer in said dye fixing element or a layer provided between said dye fixing layer and a surface protective layer.

The dye fixing element can be used to provide a good matte image that satisfies the requirements for matte surface, i.e., low gloss, texture that prevents the image from being seen white, difficulty for white spot in occurring on the transferred image, and surface condition that gives no glare.

5 Claims, No Drawings

DYE FIXING ELEMENT

FIELD OF THE INVENTION

The present invention relates to a dye fixing element for use in an image formation system which is adapted to superimpose a light-sensitive element and a dye fixing element provided on separate supports so that diffusible dyes are transferred to the dye fixing element to form an image.

BACKGROUND OF THE INVENTION

The silver halide system photography is superior to other photographic processes such as electrophotography and diazo process in sensitivity and gradation adjustment and thus has heretofore been most widely used. With reference to the silver halide system photography, many processes have been proposed which comprise imagewise forming or releasing a mobile (diffusible) dye during development, and then transferring the diffusible dye to a dye fixing element containing a mordant with the aid of a solvent such as water or heat solvent.

Such a process which comprises transferring a mobile dye to form an image is often carried out under pressure to effect uniform diffusion and transfer of such a dye. However, the pressure which can be applied to the system is naturally limited depending on the quality of the material. Therefore, the system is desired to have a surface profile that enables uniform lamination even under a low pressure.

Further, the dye fixing material is finally used for the purpose of utilizing an image in the foregoing image formation system. Therefore, surface gloss is one of the properties that are required of the material. The desired gloss of the material depends on the purpose. In order to provide texture or keep the view of image constant under various observation conditions, a so-called nongloss surface is occasionally required.

Such a nongloss surface can be normally obtained by providing the surface of the material with unevenness by a certain means. If this method is used, the gloss can be reduced by increasing the unevenness on the surface of the material. In the image formation system which is adapted to transfer a diffusible dye to form an image, however, the unevenness on the surface of the material is required to be not too great. If the surface unevenness is too great, uneven image density or white spot can occur. In a system which is adapted to spread a developer, it causes insufficient spreading of the developer. In a system which is adapted to peel the dye fixing element off the light-sensitive element, it causes the developer to be left on the surface of the image-receiving material. Therefore, in order to form a uniform image on a nongloss surface, a dye fixing element having a closely controlled surface profile is needed.

In order to obtain a matte surface, the support can be roughened as in color photographic paper. If a matte surface is prepared by this process, a relatively great surface unevenness is needed to realize a desired gloss. Further, the resulting matte surface cannot sufficiently suppress reflection and hence cannot prevent itself from giving a glary feeling, making it by no means possible to give an excellent texture.

Besides the foregoing process, a process utilizing microstructural phase separation of binder in a layer has been proposed in JP-A-3-246544, and JP-A-1-207745 (The term "JP-A" as used herein means an "unexamined published Japanese patent application"). This process is a good process which comprises providing fine and uniform unevenness to give a matte surface with an excellent texture. However, this process is disadvantageous in that it has some difficulty in controlling the height of unevenness and the period at which unevenness occurs.

Further, a process which comprises the use of a so-called matting agent, which has heretofore been used, has been proposed. However, this process is disadvantageous in that if a matting agent is incorporated in the surface protective layer as in the past to such an extent that a nongloss surface is made in cooperation with a surface protecting effect given by the surface protective layer, the proportion of the matting agent in the surface protective layer is so high that the resulting image is shown as if it is covered by a film.

SUMMARY OF THE INVENTION

It is therefore an object of the present invention to form a nongloss and nonglary image in an image formation system which is adapted to superimpose a light-sensitive element and a dye fixing element provided on separate supports upon each other so that diffusible dyes are transferred to the dye fixing element to form an image.

The foregoing object of the present invention will become more apparent from the following detailed description and examples.

The foregoing object of the present invention is accomplished with a dye fixing element for use in an image formation system which is adapted to superimpose a light-sensitive element and a dye fixing element provided on separate supports upon each other so that diffusible dyes are transferred to said dye fixing element to form an image, characterized in that a matting agent is incorporated in a layer nearer to the support than a dye fixing layer in the dye fixing element and any layer provided between the dye fixing layer and a surface protective layer.

DETAILED DESCRIPTION OF THE INVENTION

The present invention will be further described hereinafter.

Examples of matting agents employable in the present invention include various inorganic compound grains and organic compound grains (particularly polymer grains). For the object of the present invention, these grains are preferably insusceptible to elimination, deformation and migration in the image formation process. For example, if the image formation is effected with water as a dye diffusion aid under a basic condition at a high temperature, it is necessary that these grains be insoluble in water at the temperature under the pH conditions.

Examples of inorganic matting agents include grains of oxides such as silicon dioxide, titanium oxide and aluminum oxide and alkaline earth metals such as barium sulfate, calcium sulfate and magnesium, and glass grains.

Examples of organic matting agents include natural products and its modified products such as corn starch, cellulose ester and cellulose ether, and synthetic resins such as alkyl acrylate, alkyl methacrylate, acrylamide, vinylester, olefin and styrene.

Further examples of matting agents include compounds as disclosed in JP-A-61-88256, and JP-A-63-274944.

The coated amount of the matting agent to be used in the present invention is preferably in the range of 0.1 $g/m^2$ to 3 $g/m^2$. If it falls below 0.1 $g/m^2$, the resulting matte image lacks texture. On the contrary, if it exceeds 3 $g/m^2$, the resulting image exhibits a reduced maximum density or uneven dye transfer.

The grain diameter of the matting agent employable in the present invention is substantially in a range of 2 μm to 15 μm, preferably 2 μm to 12 μm, more preferably 3 μm to 10 μm. If it falls below the above defined range, the gloss of the material cannot be reduced. On the contrary, if it exceeds the above defined range, it causes an uneven dye trasfer or white mark.

The term "substantial grain diameter" as used herein indicates the grain diameter determined at the completion of film. This means that the matting agent doesn't have to have a grain diameter having the above defined range when it is in the form of starting material. Any matting agent which may be subjected to agglomeration, grinding or grain growth during the preparation, coating or drying of the coating solution to have the above defined range of grain diameter may be used.

In the present invention, a single matting agent may be used or tow or more matting agents may be used in combination. The matting agent to be used in the present invention preferably has an average grain diameter of not less than 2 μm. This is because that it is necessary to provide some unevenness to provide a nongloss surface. Further, it is desired to use this matting agent in combination with a matting agent having an average grain diameter of not more than 2 μm to make it possible to form a finer complex unevenness on the surface of the dye fixing element.

For the same reason, it is effective to make the combined use of two or more kinds of matting agents having an average grain diameters of not less than 2 μm, e.g., a matting agent having an average grain diameter of 12 μm and a matting agent having an average grain diameter of 6 μm. Further, it is useful to add a matting agent having an average grain diameter of not more than 4 μm to such a combination.

The kind of the matting agents to be used in combination may be the same or different. The term "kind" as used herein indicates the difference in the quality, shape, color tone, structure, e.g., whether or not it comprises hollow grains and difference in refractive index from core to shell, and physical properties such as glass transition temperature, refractive index and hardness.

The coat thickness of the layer containing the matting agent and the grain diameter of the matting agent are related to the strength of the coat, the phenomenon in which an image is shown as if it is covered by a white powder, and the gloss. Assuming that the nonvolatile component in the coating solution has a specific gravity of 1, and if the coating solution is uniformly coated, the coat thickness of the layer containing the matting agent can be calculated. Though depending on the refractive index of the matting agent and binder used, if the coat thickness is great with respect to the grain diameter of the matting agent, the gloss cannot be easily reduced. On the contrary, if it is small with respect to the grain diameter of the matting agent, the resulting image is shown as if it is covered by a white powder or the coat strength is reduced. For these reasons, the thickness of the layer containing the matting agent is preferably in a range of 1/10 to ½ of the average grain diameter of the matting agent.

In addition to the foregoing matting agent-containing layer, another matting agent may be incorporated in the surface protective layer to exert an effect of protecting the surface of the material. In this case, the amount of such a matting agent to be incorporated is preferably not more than 10 $g/m^2$. The matting agent to be incorporated in the surface protective layer may be the same as or different from the matting agent to be used for the object of the present invention.

The dye fixing element of the present invention is used as an image-receiving material to be used in a system in which a photographic light-sensitive material comprising a light-sensitive silver halide is developed to form or release a diffusive dye which is then transferred thereto to obtain an image.

This image formation system can be roughly divided into to two systems, i.e., so-called wet color diffusion transfer process comprising development with a processing solution at temperatures near ordinary temperature and heat development diffusion transfer process comprising heat development. The dye fixing element according to the present invention can be used as a suitable image-receiving material in either of the two systems.

The dye fixing element of the present invention can be preferably used particularly in the heat development diffusion transfer process. Thus, the dye fixing element of the present invention will be described hereinafter with reference to the heat development diffusion transfer process. This description is common to the wet color diffusion tranfer process except for the factors peculiar to the heat development such as organic silver salt and development process.

The heat-developable photographic light-sensitive material according to the present invention essentially comprises a light-sensitive silver halide emulsion and a binder on a support. It may comprise an organic metal salt oxidizer, a dye-providing compound (the reducing agent may serve also as a dye-providing compound as mentioned later) or the like incorporated therein as necessary.

These components are often incorporated in the same layer but may be separately incorporated in various layers if the reaction is made possible. For example, if a colored dye-providing compound is present in layers under the silver halide emulsion layer, it can inhibit the sensitivity drop. The reducing agent is preferably incorporated in the heat-developable photographic light-sensitive material but may be externally supplied, e.g., by allowing the reducing agent to be diffused from the dye-fixing material as mentioned later.

In order to obtain a wide range of colors in the chromaticity diagram from the subtractive primaries, i.e., yellow, magenta and cyan, at least three silver halide emulsion layers having light-sensitivity in different spectral ranges are used in combination. For example, a combination of a blue-sensitive layer, a green-sensitive layer and a red-sensitive layer, a combination of a green-sensitive layer, a red-sensitive layer and an infrared-sensitive layer, or the like may be used. These light-sensitive layers may be arranged in various orders known in the field of the ordinary type color light-sensitive materials. These light-sensitive layers may each be divided into two or more layers as necessary.

The heat-developable light-sensitive material may comprise various auxiliary layers such as protective layer, undercoating layer, interlayer, yellow filter layer, antihalation layer and backing layer.

The silver halide to be used in the present invention may be any of silver chloride, silver bromide, silver bromoiodide, silver bromochloride, silver chloroiodide and silver bromochloroiodide.

The silver halide emulsion to be used in the present invention may be a surface latent image type emulsion or an internal latent image type emulsion. The internal latent image type emulsion may be used as a direct reversal emulsion when combined with a nucleating agent or light fogging agent. The silver halide emulsion to be used in the present invention may be a so-called core-shell emulsion differing from core to shell in phase. The silver halide emulsion may be monodisperse or polydisperse. Monodisperse silver halide emulsions may be used in admixture. The grain size of silver halide grains is preferably in a range of 0.1 to 2 μm, particularly 0.2 to 1.5 μm. The crystal habit of silver halide grains may be any of cube, octahedron, tetradecahedron, tablet having a high aspect ratio, and other crystal forms.

Specifically, any of silver halide emulsions prepared by the method as disclosed in U.S. Pat. Nos. 4,500,626 (column 50), and 4,628,021, Research Disclosure (hereinafter referred to as "RD") Nos. 17029 (1978), and JP-A-62-253159 may be used.

The silver halide emulsion may be used not chemically ripened but is normally subjected to chemical sensitization before use. For example, an emulsion for the ordinary type light-sensitive material may be subjected to known sulfur sensitization, reduction sensitization, noble metal sensitization and selenium sensitization singly or in combination. These chemical sensitization processes can be effected in the presence of a nitrogen-containing heterocyclic compound as described in JP-A-62-253159.

The coated amount of the light-sensitive silver halide emulsion to be used in the present invention is in a range of 1 mg/m$^2$ to 10 g/m$^2$ as calculated in terms of silver.

In the present invention, the light-sensitive element may comprise an organic metal salt as an oxidizer in combination with the light-sensitive silver halide emulsion. Particularly preferred among these organic metal salts are organic silver salts.

Examples of organic compounds which can be used to form such an organic silver salt as an oxidizer include benzotriazoles and aliphatic acids as disclosed in U.S. Pat. No. 4,500,626, columns 52 and 53, and other compounds. Other useful examples of organic compounds include silver salts of carboxylic acids containing alkynyl group such as silver phenylpropiolate as described in JP-A-60-113235, and silver acetylene as described in JP-A-61-249044. Two or more of these organic silver salts may be used in combination.

The above mentioned organic silver salt can be used in an amount of 0.01 to 10 mole, preferably 0.01 to 1 mole per mole of light-sensitive silver halide. The sum of the coated amount of light-sensitive silver halide and organic silver salt is preferably in a range of 50 mg/m$^2$ to 10 g/m$^2$ as calculated in terms of silver.

In the present invention, various fog inhibitors or photographic stabilizers can be used. Examples of such fog inhibitors or photographic stabilizers include azoles and azaindenes disclosed in RD17643 (1978), pp. 24–25, carboxylic acids and phosphoric acids containing nitrogen disclosed in JP-A-59-168442, mercapto compounds and metallic salts thereof disclosed in JP-A-59-111636, and acetylene compounds disclosed in JP-A-62-87957.

The silver halide emulsion to be used in the present invention may be subjected to spectral sensitization with a methine dye or the like. Examples of dyes to be used in the spectral sensitization include cyanine dye, melocyanine dye, composite cyanine dye, composite melocyanine dye, holopolar cyanine dye, hemicyanine dye, styryl dye and hemioxonol dye.

Specifically, sensitizing dyes as disclosed in U.S. Pat. No. 4,617,257, JP-A-59-180550, and JP-A-60-140335, and RD17029 (1978), pp. 12–13, can be used.

These sensitizing dyes can be used singly or in combination. A combination of these sensitizing dyes is often used particularly for the purpose of supersensitization.

Besides these sensitizing dyes, a dye which doesn't exert a spectral sensitizing effect itself or a compound which doesn't substantially absorb visible light but exerts a supersensitizing effect may be incorporated in the emulsion (as disclosed in U.S. Pat. No. 3,615,641, and JP-A-63-23145).

The time at which these sensitizing dyes are incorporated in the emulsion may be during or before or after the chemical ripening or may be before or after the nucleation of silver halide grains as disclosed in U.S. Pat. Nos. 4,183,756, and 4,225,666. The amount of these sensitizing dyes to be added is normally in a range of $10^{-8}$ mole to $10^{-2}$ mole per mole of silver halide.

As the binder to be contained in the heat-developable photographic light-sensitive material or dye-fixing material there may be preferably used a hydrophilic binder. Examples of such a hydrophilic binder include those described in JP-A-62-253159, pp. 26–28. Specifically, a transparent or semitransparent hydrophilic binder is preferred. Examples of such a transparent or semitransparent hydrophilic binder include proteins or such as gelatin and gelatin derivative, natural compounds such as cellulose derivative, starch, gum arabic, dextran, pullulan and other polysaccharides, and synthetic high molecular compounds such as polyvinyl alcohol, polyvinyl pyrrolidone and acrylamide. Further, a high water absorption polymer as disclosed in JP-A-62-245260, i.e., homopolymer of vinyl monomer having —COOM or —$SO_3M$ (in which M is a hydrogen atom or alkaline metal atom) or copolymer of such vinyl monomers or copolymer of such vinyl monomers with other vinyl monomers (e.g., sodium methacrylate, ammonium methacrylate, Sumikagel L-5H available from Sumitomo Chemical Co., Ltd.) may be used. Two or more of these binders may be used in combination.

In the system where heat development is effected with the supply of a slight amount of water, if the foregoing high water absorption polymer is used, water absorption can be rapidly effected. Further, if a high water absorption polymer is incorporated in the dye-fixing layer or its protective layer, the dyes can be prevented from being re-transferred from the dye-fixig element to other elements after transfer.

In the present invention, the amount of the binder to be coated is preferably not more than 20 g/m$^2$, particularly not more than 10 g/m$^2$, more preferably not more than 0.5 g/m$^2$ to 7 g/m$^2$.

The layers (including back layer) constituting the light-sensitive material or dye fixing material may comprise various polymer latexes for the purpose of improving the film properties, e.g., stabilizing dimension and inhibiting curling, adhesion, film crack and pressure sensitization or desensitization. Specifically, any of polymer latexes as disclosed in JP-A-62-245258, JP-A-62-136648, and JP-A-62-110066 can be used. In particular, a polymer latex having glass transition point as low as 40° C. or lower can be incorporated in the mordant layer to inhibit cracking of the mordant layer. Further, a polymer latex having a high glass transition point can be incorporated in the back layer to provide an anticurling effect.

As the reducing agent to be used in the present invention there can be used one known in the field of light-sensitive material. Further, a reducer precursor which exhibits no reducing effect itself but exerts a reducing effect when acted upon by a nucleophilic reagent or heat during development can be used.

Examples of reducing agents which can be used in the present invention include reducing agents and reducer precursors as disclosed in U.S. Pat. Nos. 4,500,626 (columns 49 and 50), 4,483,914 (columns 30 and 31), 4,330,617, and 4,590,152, JP-A-60-140335, pp. 17–18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, and European Patent 220,746A2, pp. 78–96.

A combination of various reducing agents as disclosed in U.S. Pat. No. 3,039,869 can be used.

In the case where a nondiffusible reducing agent is used, an electron transfer agent and/or electron transfer agent precursor can be optionally used in combination therewith to accelerate the migration of electrons between the nondiffusible reducing agent and the developable silver halide.

Such an electron transfer agent or precursor thereof can be selected from the above mentioned reducing agents or precursors thereof. The electron transfer agent or precursor thereof preferably exhibits a greater mobility than the nondiffusible reducing agent (electron donor). Particularly useful electron transfer agents are 1-phenyl-3-pyrazolidones or aminophenols.

As the nondiffusible reducing agent (electron donor) to be used in combination with the electron transfer agent there can be selected any compounds which substantially don't migrate in the layers constituting light-sensitive material from the above mentioned reducing agents. Preferred examples of such nondiffusible reducing agents include hydroquinones, sulfonamidephenols, sulfonamidenaphtholes, compounds described as electron donors in JP-A-53-110827, and nondiffusible reucing dye providing compounds as described later.

In the present invention, the amount of the reducing agent to be added is preferably in a range of 0.01 to 20 mols, particularly 0.1 to 10 mols per mol of silver.

In the present invention, as an image-forming substance there may be used silver. Alternatively, a compound which produces or releases a mobile dye in correspondence or counter correspondence to the reaction of the reduction of silver ion to silver at a high temperature, i.e., dye providing compound may be incorporated in the system.

Examples of dye providing compounds which can be used in the present invention include compounds (couplers) which undergo oxidative coupling reaction to form a dye. These couplers may be two-equivalent or four-equivalent. Further, two-equivalent couplers containing a nondiffusible group as a separatable group which undergo oxidative coupling reaction to form a diffusible dye can be previously used. These nondiffusible groups may form a polymer chain. Specific examples of color developing agents and couplers are further described in T. H. James, "The Theory of the Photographic Process", 4th ed., pp. 291–334 and pp. 354–361, and JP-A-58-123533, JP-A-58-149046, JP-A-58-149047, JP-A-59-111148, JP-A-59-124399, JP-A-59-174835, KP-A-59-231539, JP-A-59-231540, JP-A-60-2950, JP-A-60-2951, JP-A-60-14242, JP-A-60-23474, and JP-A-60-66249.

Another example of dye providing compound is a compound which serves to imagewise release or diffuse a diffusive dye. This type of a compound can be represented by the following formula (LI):

$$(\text{Dye}-\text{Y})_n-\text{Z} \qquad \text{(LI)}$$

wherein Dye represents a dye group, or a dye group or a dye precursor group which have been temporarily shifted to short wavelength; Y represents a mere bond or a linking group; Z represents a group which makes difference in the diffusibility of the compounds represented by $(\text{Dye}-\text{Y})_n-\text{Z}$ or releases Dye to make difference in diffusibility from $(\text{Dye}-\text{Y})_n-\text{Z}$ in correspondence or counter correspondence to a light-sensitive silver salt having an imagewise latent image; and n represents an integer of 1 or 2, with the proviso that when n is 2, two (Dye−Y)'s may be the same or different.

Specific examples of the dye providing compound represented by the general formula [LI] include the following compounds (1) to (5). The compounds (1) to (3) form a diffusive dye image (positive dye image) in counter correspondence to the development of silver halide. The compounds (4) and (5) form a diffusive dye image (negative dye image) in correspondence to the development of silver halide.

(1) Dye developing agents in which a hydroquinone developing agent and a dye component are connected to each as disclosed in U.S. Pat. Nos. 3,134,764, 3,362,819, 3,597,200, 3,544,545, and 3,482,972. These dye developing agents are diffusible under alkaline conditions but react with silver halide to become nondiffusible.

(2) As described in U.S. Pat. No. 4,503,137, nondiffusible compounds can be used which release a diffusible dye under alkaline conditions but react with silver halide to lose its capability. Examples of such nondiffusible compounds include compounds which undergo intramolecular nucleophilic substitution reaction to release a diffusible dye as disclosed in U.S. Pat. No. 3,980,479, and compounds which undergo intramolecular rearrangement reaction of isooxazolone rings to release a diffusible dye as disclosed in U.S. Pat. No. 4,199,354.

(3) As disclosed in U.S. Pat. Nos. 4,559,290, and 4,783,396, European Patent 220,746A2, and Kokai Giho 87-6199, nondiffusible compounds can be used which react with a reducing agent left unoxidized upon development to release a diffusible dye.

Examples of such nondiffusible compounds include compounds which undergo intramolecular nucleophilic substitution reaction after reduction to release a diffusible dye described in U.S. Pat. Nos. 4,139,389, and 4,139,379, and JP-A-59-185333, and JP-A-57-84453, compounds which undergo intramolecular electron migration reaction after reduction to release a diffusible dye as described in U.S. Pat. No. 4,232,107, JP-A-59-

101649, and JP-A-61-88257, and RD24025 (1984), compounds which undergo cleavage of single bond after reduction to release a diffusible dye as described in West German Patent 3,008,588A, JP-A-56-142530, and U.S. Pat. Nos. 4,343,893, and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

Preferred examples of such nondiffusible compounds include compounds containing N—X bond (in which X represents an oxygen, sulfur or nitrogen atom) and an electrophilic group in a molecule disclosed in European Patent 220,746A2, Kokai Giho 87-6199, U.S. Pat. No. 4,783,396, and JP-A-63-201653, and JP-A-63-201654, compounds containing $SO_2$—X bond (in which X is as defined above) and an electrophilic group in a molecule disclosed in JP-A-1-26842, compounds containing PO—X bond (in which X is as defined above) and an electrophilic group in a molecule disclosed in JP-A-63-271344, and compounds containing C—X' bond (in which X' has the same meaning as X or represents —$SO_2$—) and an electrophilic group in a molecule disclosed in JP-A-63-271341. Compounds which undergo cleavage of single bond after reduction by K bond conjugated with electron accepting group to release a diffusible dye as disclosed in JP-A-1-161237 and JP-A-1-161342 can also be used.

Particularly preferred among these compounds are compounds containing N—X bond and an electrophilic group per molecule. Specific examples of these compounds include Compounds (1) to (3), (7) to (10), (12), (13), (15), (23) to (26), (31), (32), (35), (36), (40), (41), (44), (53) to (59), (64) and (70) disclosed in European Patent 220,746A2 or U.S. Pat. No. 4,783,396, and Compounds (11) to (23) disclosed in Kokai Giho 87-6199.

(4) Coupler compounds containing a diffusible dye as a releasable group which undergo reaction with an oxidation product of a reducing agent to release a diffusible dye (DDR couplers). Specific examples of such DDR couplers are described in British Patent 1,330,524, JP-B-48-39165 (The term "JP-B" as used herein means an "examined Japanese patent publication"), and U.S. Pat. Nos. 3,443,940, 4,474,867, and 4,483,914.

(5) Compounds which are capable of reducing silver halides or organic silver salts and release a diffusible dye when reducing the silver halides or organic silver salts (DRR compounds). These compounds do not require the use of other reducing agents, eliminating the stain on the image caused by an oxidative decomposition product of reducing agents. Typical examples of such DRR compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, and JP-A-57-179840, and RD17465. Specific examples of these DRR compounds include compounds as disclosed in U.S. Pat. No. 4,500,626, columns 22 to 44. Particularly preferred among these compounds are Compounds (1) to (3), (10) to (13), (16) to (19), (28) to (30), (33) to (35), (38) to (40), and (42) to (64). Further, compounds as described in U.S. Pat. No. 4,639,408, columns 37 to 39, are useful.

As dye providing compounds other than the above mentioned couplers and dye providing compounds represented by the general formula (LI) there can be used dye silver compounds in which an organic silver salt and a dye are connected to each other (Research Disclosure, May 1978, pp. 54–58), azo dyes for use in heat development silver dye bleaching process (U.S. Pat. No. 4,235,957, Research Disclosure, April 1976, pp. 30–32), and leuco dyes (U.S. Pat. Nos. 3,985,565, and 4,022,617).

The incorporation of a hydrophobic additive such as dye providing compound and nondiffusible reducing agent into the layers constituting the light-sensitive materialcan be accomplished by any known method. In this case, a high boiling organic solvent disclosed in JP-A-59-83154, JP-A-59-178451, JP-A-59-178452, JP-A-59-178453, JP-A-59-178454, JP-A-59-178455, and JP-A-59-178457 can be used in combination with a low boiling point organic solvent having a boiling point of 50° C. to 160° C. as necessary.

The amount of the high boiling organic solvent to be used is in a range of 10 g or less, preferably 5 g or less per g of dye providing compound used or 1 cc or less, more preferably 0.5 cc or less, particularly 0.3 cc or less per g of binder used.

Alternatively, a dispersion process with a polymer as described in JP-B-51-39853, and JP-A-51-59943 can be used.

A compound substantially insoluble in water can be finely dispersed in the binder rather than using the above mentioned methods.

When a hydrophobic compound is dispersed in a hydrophilic colloid, various colloids can be used. For example, compounds disclosed as surface active agents in JP-A-59-157636, pp. 37–38, can be used.

In the present invention, a compound which not only activates development but also stabilizes an image may be incorporated in the light-sensitive material. Specific examples of such compounds which can be preferably used are described in U.S. Pat. No. 4,500,626, columns 51 to 52.

In the system where an image is formed by the diffusion transfer of a dye, a dye-fixing material is used in combination with the heat-developable photographic light-sensitive material. The dye-fixing material may be separately coated on a support different from that for the photographic light-sensitive material or may be coated on the same support as the photographic light-sensitive material. For the relationship between the photographic light-sensitive material and the dye-fixing material, between the photographic light-sensitive material and the support and between the photographic light-sensitive material and the white reflective layer, those disclosed in U.S. Pat. No. 4,500,626 (column 57) can apply to the present invention.

Referring to a preferred layer configuration of the dye fixing element according to the present invention, it may comprise at least a dye fixing layer, a matting agent-containing layer, and a surface protective layer provided on a support in this order or may comprise at least a matting agent-containing layer, a dye fixing layer, a matting agent-containing layer, and a surface protective layer provided on a support in this order.

The dye fixing element according to the present invention may comprise various auxiliary layers such as peel layer, hardener supply layer, interlayer, anticurling layer and backing layer as necessary. One or more of these layers may comprise a hydrophilic heat solvent, a plasticizer, a discoloration inhibitor, a UV absorbent, a lubricant, an oxidation inhibitor, etc.

The dye fixing layer in the dye fixing element according to the present invention preferably comprises a polymer mordant capable of fixing a mobile dye produced or released by development.

Examples of the polymer mordant include polymer containing a tertiary amino group, a polymer containing a nitrogen-containing heterocyclic portion, and a polymer containing a quaternary cationic group. Such a polymer mordant is preferably used in admixture with other hydrophilic polymers (e.g., gelatin).

Polymers containing vinyl monomer units having tertiary amino groups are described in JP-A-60-60643, and JP-A-60-57836. In particular, polymers containing vinyl monomer units having tertiary imidazole groups are preferably used in the light of fastness to light and transfer density. Specific examples of such polymers are described in JP-A-60-118834, JP-A-60-122941, JP-A-62-244043, and JP-A-62-244036, and U.S. Pat. Nos. 4,282,305, 4,115,124, and 3,148,061.

Preferred examples of polymers containing vinyl monomer units having quaternary imidazolium salts are described in British Pat. Nos. 2,056,101, 2,093,041, and 1,594,961, U.S. Pat. Nos. 4,124,386, 4,115,124, 4,273,853, and 4,450,224, and JP-A-48-28225.

Further, preferred examples of polymers containing vinyl monomer units having quaternary ammonium salts are described in U.S. Pat. Nos. 3,709,690, 3,898,088, and 3,958,995, and JP-A-60-57836, JP-A-60-60643, JP-A-60-122940, JP-A-60-122942, and JP-A-60-235134.

The molecular weight of the polymer mordant to be used in the present invention is preferably in a range of 1,000 to 1,000,000, particularly 10,000 to 200,000.

Such a polymer mordant is incorporated in the dye fixing layer in the dye fixing element in combination with a hydrophilic colloid as a binder.

The mixing proportion of polymer mordant to hydrophilic colloid and the coated amount of polymer mordant can be easily determined by those skilled in the art depending on the amount of the dye to be mordanted, the kind and composition of polymer mordant, the image formation method to be used, etc. Preferably, the mixing proportion by weight of mordant to hydrophilic colloid is in a range of 20/80 to 80/20, and the coated amount of mordant is in a range of about 0.2 $g/m^2$ to about 15 $g/m^2$, particularly 0.5 $g/m^2$ to 8 $g/m^2$.

The polymer mordant can be incorporated in the image receiving material in combination with metallic ions to raise the transfer density of dye. These metallic ions can be incorporated in the mordant layer containing a mordant or adjacent layers (which may be close to or remote from the support carrying the dye fixing layer, etc.). These metallic ions are preferably transparent and stable to heat and light. In other words, these metallic ions are preferably polyvalent ions of transition metals such as $Cu^{2+}$, $Zn^{2+}$, $Ni^{2+}$, $Pt^{2+}$, $Pd^{2+}$ and $Co^{3+}$, particularly $Zn^{2+}$. These metallic ions are normally incorporated in the system in the form of water-soluble compound such as $ZnSO_4$ and $Zn(CH_3CO_2)_2$. The amount of these metallic ions to be added is preferably in a range of about 0.1 $g/m^2$ to about 5 $g/m^2$, more preferably 0.1 $g/m^2$ to 1.5 $g/m^2$.

The dye fixing layer comprising such a polymer mordant may comprise various surface active agents for the purpose of improving the coating properties of the material or like purposes.

In a particularly effective embodiment, the dye fixing element according to the present invention comprises a water-soluble base and/or base precursor in the dye fixing layer or other layers related thereto on the same side of the support for the purpose of simplifying and expediting processing.

Examples of bases to be used in the present invention include inorganic bases such as hydroxide, carbonate, bicarbonate, borate and secondary and tertiary phosphate of alkaline metal and quaternary alkylammonium, organic bases such as aliphatic amines, aromatic amines, heterocyclic amines, amidines, cyclic amidines, guanidines and cyclic guanidines, and carbonate, bicarbonate, borate, and secondary and tertiary phosphate thereof.

As an example of the base precursor to be used in the present invention there can be used the above mentioned base precursor which undergoes thermal decomposition or electrolysis to release a basic component.

Examples of such a base precursor which undergoes thermal decomposition to produce a base include a salt of a thermally-decomposable organic acid such as trichloroacetic acid, cyanoacetic acid, acetoacetic acid and $\alpha$-sulfonylacetic acid with the above mentioned organic base or 2-carboxycarboxamide as described in U.S. Pat. No. 4,088,496. In addition, compounds as described in British Patent 998,945, U.S. Pat. No. 3,220,846, and JP-A-50-22625 can be used.

Examples of the base precursor which undergoes electrolysis to produce a base include compounds which undergo electrolytic oxidation to produce carbonates of alkaline metal and organic bases such as guanidines and amidines, and compounds which undergo electrolytic reduction to produce a base (e.g., production of amines by the reduction of nitro and nitroso compounds, production of amines by the reduction of nitriles, production of p-aminophenols, p-phenylenediamines or hydrazines by the reduction of nitro compounds, azo compounds or azoxy compounds). p-Aminophenols, p-phenylenediamines and hydrazines may be used not only as bases but also directly as color image-forming substances. It goes without saying that the electrolysis of water in the presence of various inorganic salts to produce an alkaline component can be utilized.

Further, as mentioned in U.S. Pat. No. 4,740,445, the reaction of a compound (e.g., guanidium picolate) capable of complexing with metallic ions constituting a sparingly soluble metal salt compound (e.g., zinc oxide, basic zinc carbonate, calcium carbonate) in the presence of water as a medium with the sparingly soluble metal salt compound to produce a water-soluble base can be particularly preferably used. In accordance with this method, a light-sensitive material comprising a dispersion of the sparingly soluble metal salt compound incorporated therein and a dye fixing element comprising a water-soluble compound capable of complexing with the metallic ions incorporated therein can be subjected to heat treatment while in close contact with each other in the presence of water to produce a base. Thus, this method is particularly effective in the light of storability of the light-sensitive element and dye fixing element. In this case, the compound capable of undergoing complexing reaction is a base precursor as defined herein in that it undergoes complexing reaction with a difficultly soluble metallic compound with water as a medium to produce a base.

These bases and/or base precursors may be used singly or in combination.

The amount of these bases and/or base precursors to be used is normally in a range of $5\times10^{-4}$ to $5\times10^{-1}$ mole/m$^2$, preferably $2.5\times10^{-3}$ to $2.5\times10^{-2}$ mole/m$^2$.

The dye fixing element according to the present invention may comprise a polymer dispersion in the dye fixing layer or other layers related to the dye fixing element on the same side of the support for the purpose of improving the anticurling effect.

The polymer dispersion is preferably such that the polymer constituting the dispersion exhibits a glass transition temperature of 25° C. or lower. Even if the glass transition temperature of the polymer is 25° C. or higher, the polymer may be used in combination with an oily plasticizer to substantially exhibit a glass transition temperature of 25° C. or lower. In order to incorporate the plasticizer in the polymer dispersion, the plasticizer may be present in the system during the synthesis. In general, the polymer dispersion may be stirred for a predetermined period of time in admixture with the plasticizer emulsion. Examples of the polymer dispersion to be used in the present invention include latexes synthesized by the emulsion single polymerization or emulsion copolymerization of vinyl acetate, ethylene-vinyl acetate, acryl, vinylidene chloride, vinyl chloride, butadiene or butadiene derivatives, and polymer dispersions obtained by the emulsion dispersion of a solution of the above mentioned polymers, polyesters and polyrethanes or the like in an organic solvent. In particular, vinyl acetate, ethylene-vinyl acetate, acryl and styrene-butadiene dispersions are preferably used from the standpoint of fastness to light, thermal stability, diffusion stability of coating solution, anticurling effect, inhibition of deposition of salts, etc.

Specific examples of such a polymer dispersion will be given below, but the present invention should not be construed as being limited thereto.

Examples of commercially available latexes and emulsions include Nipol LX811, 814, 820, 821, 822, 823, 825, 826, 842, 851, 852, 854, 855, 857, 860, 874, 110, 112, 119, 139, 206, 209, 600, 415A, 426, 430, 432A, 433, 435, 436, 438C, 472, 473, 479, 511, 513, 517, 518, 531, 407F (produced by Nippon Zeon Co., Ltd.), Polysol (various latexes or emulsions of vinyl acetate, vinyl acetate-acrylic, acrylate ester, vinyl acetate-veoVa, styrene-acrylic and ethylene-vinyl acetate commercially available from Showa High Polymer Co., Ltd.), and VONDIC 1040, 1050, 1310F, 1320NS, 1340, 1510, 1610NS, 1612NS, 1640, 1660, 1670 (N), 1930N, 1980 (produced by Dainippon Ink And Chemicals, Inc.).

The amount of the polymer latex to be added is defined as the proportion of the total volume of polymer in the latex incorporated in the layer to the total volume of the hydrophilic binder incorporated in the layer and is preferably in a range of 5 to 300 vol. %, more preferably 10 to 200 vol. %. As calculated in terms of coated amount, the amount of the polymer latex to be added is preferably in a range of 0.5 g/m$^2$ to 10 g/m$^2$, more preferably 1 g/m$^2$ to 5 g/m$^2$.

The polymer latex to be used in the present invention exerts remarked effects if a polymer mordant having a high glass transition temperature, particularly 25° C. or higher is used.

As the binder to be contained in the dye fixing element there may be preferably used a hydrophilic binder. Examples of such a hydrophilic binder include those described in JP-A-62-253159, pp. 26–28. Specifically, a transparent or semitransparent hydrophilic binder is preferred. Examples of such a transparent or semitransparent hydrophilic binder include proteins or such as gelatin and gelatin derivative, natural compounds such as cellulose derivative, starch, gum arabic, dextran, pullulan and other polysaccharides, and synthetic high molecular compounds such as polyvinyl alcohol, polyvinyl pyrrolidone and acrylamide. Further, a high water absorption polymer as disclosed in JP-A-62-245260, i.e., homopolymer of vinyl monomer having —COOM or —$SO_3$M (in which M is a hydrogen atom or an alkaline metal atom) or copolymer of such vinyl monomers or copolymer of such vinyl monomers with other vinyl monomers (e.g., sodium methacrylate, ammonium methacrylate, Sumikagel L-5H available from Sumitomo Chemical Co., Ltd.) may be used. Two or more of these binders may be used in combination.

For silver halide emulsions, spectral sensitizing dyes, emulsion layers, full color multilayer structure and processing compositions to be used in color diffusion transfer process, color diffusion transfer film units and its constituent layers, reference can be made to JP-A-2-32335, line 8, lower right column, page 17–line 19, lower right column, page 20.

The heat-developable photographic light-sensitive material may comprise various auxiliary layers such as protective layer, undercoating layer, interlayer, yellow filter layer, antihalation layer and backing layer.

For silver halides, silver halide emulsions, organic metallic salt oxidizers, fog inhibitors, photographic stabilizers, binders, reducing agents, electron transfer agents, elelctron donors, and dye-providing compounds to be incorporated in the heat-developable light-sensitive element, layers constituting the heat-developable light-sensitive element or dye fixing element, fluororescent brightening agents, hardeners, surface active agents, organic fluoro compounds, matting agents, heat solvents, anti-foaming agents, bacteriocides, mildew-proofing agents, colloidal silica, image formation accelerators, bases and base precursors to be incorporated therein, compounds for stabilizing image, supports to be used for the heat-developable light-sensitive element or dye fixing element, heating means for use in the heat development, heat development process, mobile solvents for use in the heat development, heat development apparatus, exposure methods, etc., referece can be made to JP-A-2-32335, line 10, lower right column, page 21–line 2, lower right column, page 29.

As an example of the foregoing heat-developable light-sensitive element there can be used a commercially available compound as described later.

The layers constituting the light-sensitive material and dye fixing material can comprise a plasticizer, a lubricant or a high boiling organic solvent as an agent for improving the peelability between the light-sensitive material and the dye fixing material. Specific examples of these agents include those described in JP-A-62-253159, page 25, and JP-A-62-245253.

Further, for the above mentioned purposes, various silicone oils (ranging from dimethyl silicone oil to modified silicone oils obtained by incorporating various organic groups in dimethyl siloxane) can be used. Useful examples of such silicone oils are various modified silicone oils described in "Modified Silicone Oil" (technical report published by Shin-Etsu Silicone Co., Ltd.), page 6–18B, particularly carboxy-modified silicone (trade name: X-22-3710).

Further, silicone oils as disclosed in JP-A-62-215953, and JP-A-63-46449 can also be effectively used.

The light-sensitive material or dye fixing material may comprise a discoloration inhibitor. Examples of such a discoloration inhibitor include antioxidant, ultraviolet absorbent, and various metal complexes.

Examples of such an antioxidant include chroman compounds, coumaran compounds, phenol compounds (e.g., hindered phenols), hydroquinone derivative, hindered amine derivative, and spiroindan compounds. Further, compounds as described in JP-A-61-159644 can also be effectively used as antioxidant.

Examples of ultraviolet absorbents to be used as discoloration inhibitors include benzotriazole compounds disclosed in U.S. Pat. No. 3,533,794, 4-thiazolidone compounds disclosed in U.S. Pat. No. 3,352,681, benzophenone compounds disclosed in JP-A-46-2784, and compounds disclosed in JP-A-54-48535, JP-A-62-136641, and JP-A-61-88256. Further, ultraviolet-absorbing polymers disclosed in JP-A-62-260152 can also be effectively used as ultraviolet absorbents.

Examples of metal complexes to be used as discoloration inhibitors include compounds disclosed in U.S. Pat. Nos. 4,241,155, 4,245,018, columns 3–36, and 4,254,195, columns 3–8, and JP-A-62-174741, JP-A-61-88256, pp. 27–29, JP-A-63-199248, JP-A-1-75568, and JP-A-1-74272.

Useful examples of such discoloration inhibitors are disclosed in JP-A-62-215272, pp. 125–137.

The discoloration inhibitor for inhibiting the transfer of a dye which has been transferred to the dye fixing element may be previously incorporated in the dye fixing material or supplied into the dye fixing material externally, e.g., from the light-sensitive material.

The above mentioned antioxidant, ultraviolet absorbents and metal complexes may be used in combination.

The light-sensitive material or dye fixing element may comprise a fluorescent brightening agent. In particular, such a fluorescent brightening agent is preferably incorporated in the dye fixing element or supplied into the dye fixing material externally, e.g., from the light-sensitive material. Examples of such a fluorescent brightening agent include compounds as disclosed in K. Veenkataraman, "The Chemistry of Synthetic Dyes", vol. V, Chapter 8, and JP-A-61-143752. Specific examples of such a fluorescent brightening agent include stilbene compounds, coumarine compounds, biphenyl compounds, benzoxazolyl compounds, naphthalimide compounds, pyrazoline compounds, and carbostyryl compounds.

Such a fluorescent brightening agent can be used in combination with a discoloration inhibitor.

Examples of film hardeners to be incorporated in the layers constituting the light-sensitive element or dye fixing material include those described in U.S. Pat. No. 4,678,739, and JP-A-59-116655, JP-A-62-245261, and JP-A-61-18942. Specific examples of such film hardeners include aldehyde film hardeners (e.g., formaldehyde), aziridine film hardeners, epoxy film hardeners, vinylsulfone film hardeners (e.g., N,N'-ethylenebis(-vinylsulfonylacetamide)ethane), N-methylol film hardeners (e.g., dimethylolurea), and high molecular film hardeners (e.g., compounds described in JP-A-62-234157).

The layers constituting the light-sensitive element or dye fixing material can comprise various surface active agents for the purpose of aiding coaing, improving peelability and slip properties, inhibiting electrification, accelerating development or like purposes. Specific examples of such surface active agents are described in JP-A-62-173463, and JP-A-62-183457.

The layers constituting the heat-developable photographic light-sensitive material or dye fixing element can comprise an organic fluoro compound incorporated therein for the purpose of improving slip properties and peelability, inhibiting electrification or like purposes. Typical examples of such an organic fluoro compound include fluoro surface active agents disclosed in JP-B-57-9053, columns 8 to 17, JP-A-61-20944, and JP-A-62-135826, and hydrophobic fluorine compounds such as oil fluorinic compound, e.g., fluorine oil, and solid fluorine compound resin, e.g., ethylene tetrafluoride resin.

The photographic light-sensitive material may comprise a matting agent incorporated therein. As such a matting agent there can be used the same compound as used for the dye fixing element according to the present invention.

In addition, the layers constituting the photographic light-sensitive material and dye fixing element may comprise a heat solvent, an anti-foaming agent, a bacteriacide, a mildewproofing agent, a colloidal silica, etc. These additives are further described in JP-A-61-88256, pp. 26–32.

In the present invention, the heat-developable photographic light-sensitive material and/or dye fixing element can comprise an image formation accelerator. Such an image formation accelerator serves to accelerate the redox reaction of a silver salt oxidizing agent and a reducing agent, accelerate reaction such as production or decomposition of a dye from a dye providing substance and release a diffusible dye from a dye providing substance or accelerate the migration of a dye from the heat-developable photographic light-sensitive material layer to the dye fixing layer. From the standpoint of physicochemical function, the image formation accelerator can be classified as base or base precursor, nucleophilic compound, high boiling organic solvent (oil), heat solvent, surface active agent, compound interacting with silver or silver ion, etc. However, these substance groups normally have composite functions and exert some of these accelerating effects in combination. These image formation accelerators are further described in U.S. Pat. No. 4,678,739, columns 38 to 40.

Examples of base precursors include salts of heat decarboxylating organic acids and bases, compounds releasing amines by the Lossen rearrangement or Beckmann rearrangement, specific examples being disclosed in U.S. Pat. No. 4,511,493 and JP-A-62-65038.

In the system where heat development and dye transfer are simultaneously effected in the presence of a small amount of water, a base and/or a base precursor is preferably incorporated in the dye fixing element to enhance the preservability of the heat-developable photographic light-sensitive material.

In addition to the foregoing base precursors, a combination of a sparingly soluble metal compound and a compound capable of undergoing complexing reaction with metal ions constituting the sparingly soluble metal compound (i.e., complexing compound) disclosed in EP 210,660, and U.S. Pat. No. 4,740,445 and a compound which undergoes electrolysis to produce a base as disclosed in JP-A-61-232451 may be used as base precursors. In particular, the former is effective. The sparingly soluble metal compound and the complexing compound are advantageously incorporated separately in the heat-developable photographic light-sensitive material and the dye-fixing material as disclosed in the foregoing patents.

In the present invention, the heat-developable light-sensitive material and/or the dye fixing element may comprise various development terminator for the purpose of obtaining an invariably constant image quality against the fluctuation of processing temperatue and time during development.

The development terminator is a compound which rapidly neutralizes or reacts with a base after a proper development to reduce the base concentration in the film to terminate development or a compound which interacts with silver or a silver salt after a proper development to inhibit develoment. Specific examples of such a development terminator include an acid precursor which releases an acid under heating, an electrophilic compound which undergoes substitution reaction with a base present therewith under heating, a nitrogen-containing heterocyclic compound, and a mercapto compound and precursor thereof. These compounds are further described in JP-A-62-253159, pp. 31–32.

In the present invention, as the support for the heat-developable light-sensitive material and the dye fixing material there can be used any support material which can withstand the processing temperature. In general, photographic supports such as paper and synthetic high molecular compounds (film) are used. Examples of such support materials include polyethylene terephthalate, polycarbonate, polyvinyl chloride, polystyrene, polypropylene, polyimide, cellulose (e.g., triacetyl cellulose), support materials obtained by incorporating a pigment such as titanium oxide in these films, synthetic paper obtained by film process of polypropylene, mixed paper made from a synthetic resin pulp such as polyethylene and a natural pulp, Yankee paper, baryta paper, coated paper (particularly cast coat paper), metal, cloth, and glass.

These support materials can be used directly or in the form of laminate with a synthetic high molecular compound such as polyethylene on one or both sides thereof.

Besides these support materials, support materials as disclosed in JP-A-62-253159, pp. 29–31, can be used.

Onto the surface of these support materials may be coated a hydrophilic binder, an oxide of semiconductive metal such as alumina sol and tin oxide, carbon black, and other antistatic agents.

Examples of methods for imagewise exposing the photographic light-sensitive material to record an image thereon include method which comprises directly photographing scene or persons using a camera or the like, method which comprises exposure through a reversal film or a negative film using a printer or enlarger, method which comprises scanning exposure to an orginal image through a slit using an exposing apparatus in a copying machine, method which comprises exposure to light emitted by a light emitting diode or various lasers excited by an electrical signal representative of image data, and method which comprises exposure directly or through an optical system to image data outputted to an image display apparatus such as CRT, liquid crystal display, electroluminescence display and plasma display.

Examples of light sources to be used in recording an image on the photographic light-sensitive material include natural light, tungsten lamp, light emitting diode, laser, CRT, and other light sources as described in U.S. Pat. No. 4,500,626, column 56.

Further, a wavelength modulator in which a nonlinear optical material is combined with a coherent light source such as laser can be used to effect imagewise exposure. The nonlinear optical material is a material capable of expressing nonlinearity between polarization and electric field created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As wavelength modulators there have been known single crystal optical waveguide type wavelength modulator, fiber type wavelength modulator, etc. Any of these types of wavelength modulators can be effectively used.

Examples of the image data which can be used include image signal obtained from video camera, electronic still camera, etc., television signal stipulated by National Television Signal Code (NTSC), image signal obtained by dividing an orginal image into many pixels by a scanner, and image signal produced by compueters such as CG and CAD.

The heat-developable light-sensitive material and/or the dye-fixing element may comprise an electrically conductive heating element layer as a heating means for heat development and diffusion transfer of dye. As transparent or opaque heating elements, for a heating element there may be used one disclosed in JP-A-61-145544. Such an electrically conductive heating element layer may also serve as an antistatic layer.

The heating temperature at the heat development process is normally in the range of about 50° C. to 250° C., particularly about 80° C. to 180° C. The diffusion transfer of a dye may be effected at the same with or after the heat development process. In the latter case, the transfer of a dye can be effected at a heating temperature ranging from the heat development temperature to room temperature, particularly preferably 50° C. to a temperature about 10° C. lower than the heat development temperature.

The migration of a dye can be effected by heat alone. In order to accelerate the migration of a dye, a solvent may be used. As described in detail in JP-A-59-218443 and JP-A-61-238056, the system is preferably heated in the presence of a small amount of a solvent (particularly water) to simultaneously or successively effect development and transfer. In this process, the heating temperature is preferably from 50° C. to a temperature lower than the boiling point of the solvent, e.g., 100° C. or lower if the solvent is water.

Examples of solvents to be used in the acceleration of development and/or the migration of diffusible dyes to the dye fixing layer include water, and a basic aqueous solution containing an inorganic alkaline metal salt or an organic base (these bases include those described with reference to the image formation accelerator). Further, a low boiling solvent, and a mixture of a low boiling solvent and water or basic aqueous solution may be used. Moreover, a surface active agent, a fog inhibitor, a sparingly soluble metal salt, a complexing compound, etc. may be contained in these solvents.

These solvents may be provided to either or both of the dye fixing element and the light-sensitive material. The amount of these solvents to be used may be not more than the weight thereof corresponding to the maximum swellable volume of the coated film (particularly the weight thereof corresponding to the maximum swellable volume of the coated film minus the weight of the coated film).

In order to provide these solvents to the light-sensitive layer or dye fixing layer, a method disclosed in JP-A-61-147244, page 26, can be used. Alternatively, these solvents may be previously in either or both of the light-sensitive material and the dye fixing material in the form of microcapsule.

In order to accelerate the migration of a dye, a hydrophilic heat solvent which stays solid at normal temperature but becomes soluble at an elevated temperature may be incorporated in the light-sensitive material or the dye fixing element. Such a hydrophilic heat solvent may be incorporated in one of or both of the light-sensitive material and the dye fixing material. The layer in which the hydrophilic heat solvent is incorporated may be any of emulsion layer, interlayer, protective layer and dye fixing layer, preferably dye fixing layer and/or its adjacent layers.

Examples of such a hydrophilic heat solvent include ureas, pyridines, amides, sulfonamides, imides, alcohols, oxims, and other heterocyclic groups.

In order to accelerate the migrattion of a dye, a high boiling organic solvent may be incorporated in the light-sensitive material and/or the dye fixing element.

Examples of the heating means at the development and/or the transfer process include a method which comprises bringing the material into contact with a heated block or plate, a hot plate, a hot presser, heat roller, halogen lamp heater, infrared lamp heater, far infrared lamp heater, etc., and a method which comprises passing the material through a high temperature atmosphere.

As pressure conditions and pressure application methods by which the light-sensitive material and the dye fixing element are laminated and adhered to each other there can be used those described in JP-A-61-147244, page 27.

The processing of the photographic elements of the present invention can be accomplished by means of any of various heat development apparatus. For example, apparatus described in JP-A-59-75247, JP-A-59-177547, JP-A-59-181353, and JP-A-60-18951, and JU-A-59-25944 may be preferably used (The term "JU-A" as used herein means an unexamined Japanese Utility Model publication).

The present invention will be further described in the following examples, but the present invention should not be construed as being limited thereto.

EXAMPLE 1

A process for the preparation of a dispersion of zinc hydroxide will be described below.

12.5 g of zinc hydroxide grains having an average grain size of 0.2 μm, 1 g of carboxylmethyl cellulose as a dispersant, and 0.1 g of sodium polyacrylate were added to 100 ml of a 4% aqueous solution of gelatin. The mixture was ground with glass beads having an average grain diameter of 0.75 mm by means of a mill for 30 minutes. The glass beads were then removed from the mixture to obtain a dispersion of zinc hydroxide.

A process for the preparation of a dispersion of electron transfer agent will be described below.

10 g of electron transfer agent (1), 0.5 g of a polyethylene glycol nonylphenyl ether as a dispersant, and 0.5 g of anionic surface active agent (1) were added to a 5% aqueous solution of gelatin. The mixture was then ground with glass beads having an average grain diameter of 0.75 mm by means of a mill for 60 minutes. The glass beads were then removed from the mixture to obtain a dispersion of electron transfer agent having an average grain diameter of 0.35 μm.

Electron transfer agent (1)

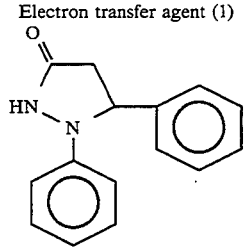

Anionic surface active agent (1)

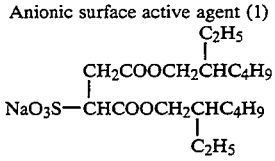

A process for the preparation of a dispersion of dye trapping agent will be described below.

To a mixture of 108 ml of polymer latex (1) (solid content: 13%), 20 g of nonionic surface active agent (1) and 1,232 ml of water was added 600 ml of a 5% aqueous solution of anionic surface active agent (1) with stirring in 10 minutes. The dispersion thus prepared was concentrated to 500 ml by means of an ultrafiltration module, and then desalted. To the dispersion was then added 1,500 ml of water. The same procedure was repeated once to obtain 500 g of a dispersion of dye trapping agent.

Polymer latex (1)

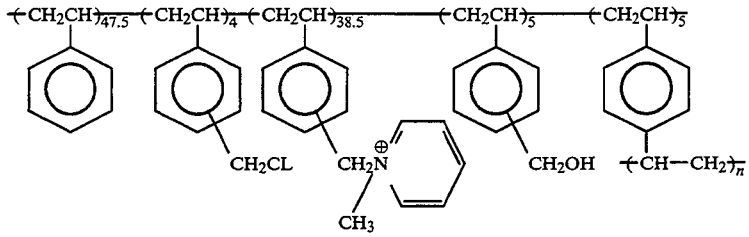

Nonionic surface active agent (1)

-continued

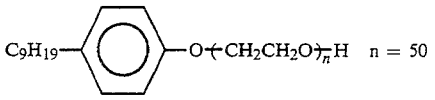

A process for the preparation of a gelatin dispersion of hydrophobic additive will be described below.

Gelatin dispersions of cyan dye-providing compound, magenta dye-providing compound, yellow dye-providing compound and electron donor were prepared in accordance with the formulations as set forth in Table 1. In some detail, each oil phase component was dissolved under heating to a temperature of about 60° C. to make a homogenous solution. To the solution thus obtained was then added an aqueous phase component which had been heated to a temperature of about 60° C. with stirring. The mixture was then subjected to dispersion at 1,200 rpm by a homogenizer for 13 minutes. To the dispersion was then added water with stirring to obtain a homogenous dispersion.

TABLE 1

| Phase | Component | Cyan (g) | Magenta (g) | Yellow (g) | Electron donor (g) |
|---|---|---|---|---|---|
| Oil | Cyan dye-providing compound (1) | 9.05 | — | — | — |
| | Cyan dye-providing compound (2) | 6.19 | — | — | — |
| | Magenta dye-providing compound (1) | — | 15.5 | — | — |
| | Yellow dye-providing compound (1) | — | — | 13.0 | — |
| | Electron donor (1) | 4.84 | 5.61 | 4.53 | — |
| | Electron donor (2) | — | — | — | 13.87 |
| | Inhibitor-releasing precursor (1) | — | — | — | 2.63 |
| | Electron transfer agent precursor (1) | 1.42 | 1.42 | 0.86 | — |
| | Fog inhibitor (1) | 0.40 | 0.44 | 0.40 | — |
| | Ultraviolet absorbent (1) | 1.53 | 1.94 | — | — |
| | Ultraviolet absorbent (2) | 1.52 | 1.94 | — | — |
| | High boiling solvent (1) | 1.91 | 1.94 | 5.20 | — |
| | High boiling solvent (2) | — | — | 3.90 ml | — |
| | High boiling solvent (3) | 5.72 | 5.81 | — | 2.93 |
| | High boiling solvent (4) | — | — | — | 2.94 |
| | Anionic surface active agent (2) | 1.55 | 0.52 | 1.50 | 0.45 |
| | Ethyl acetate | 34.5 ml | 34.5 ml | 25.0 ml | 18.0 ml |
| | Methyl ethyl ketone | 47.5 ml | 47.5 ml | — | — |
| Aqueous | Gelatin | 10.0 | 10.0 | 10.0 | 10.0 |
| | Citric acid | — | — | 0.14 | 0.14 |
| | Sodium hydrogensulfite | — | — | — | 0.15 |
| | Water | 150 ml | 150 ml | 120 ml | 97.0 ml |
| | Water | 150 ml | 160 ml | 115 ml | 61.0 ml |

Cyan dye-providing compound (1)

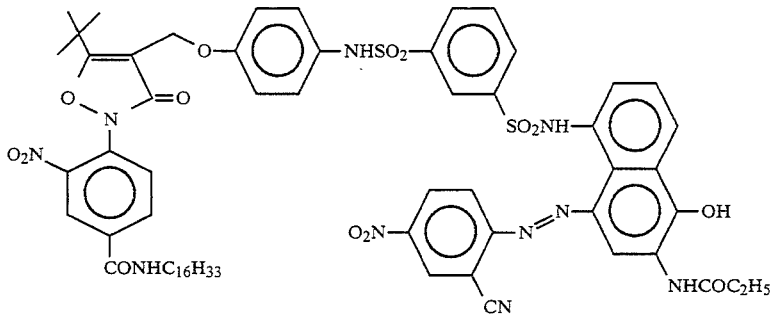

Cyan dye-providing compound (2)

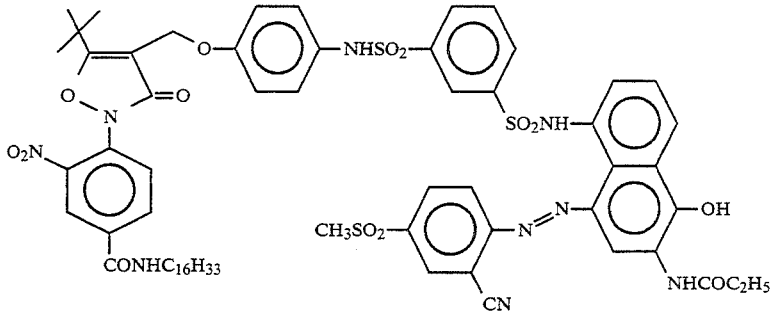

Magenta dye-providing compound (1)

TABLE 1-continued
| Phase | Component | Cyan (g) | Magenta (g) | Yellow (g) | Electron donor (g) |
|---|---|---|---|---|---|
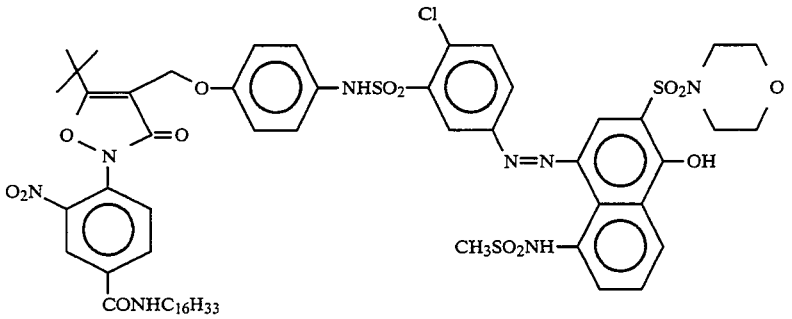
Yellow dye-providing compound (1)
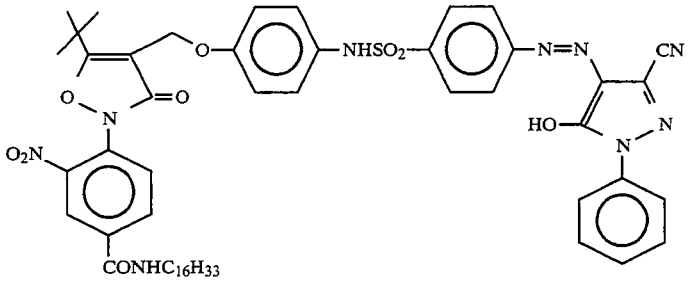
Electron donor (1)
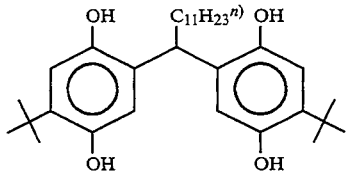
Electron donor (2)
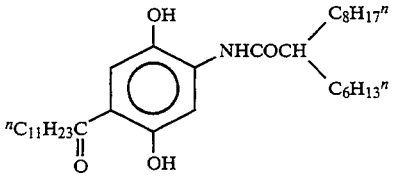
Inhibitor-releasing precursor (1)
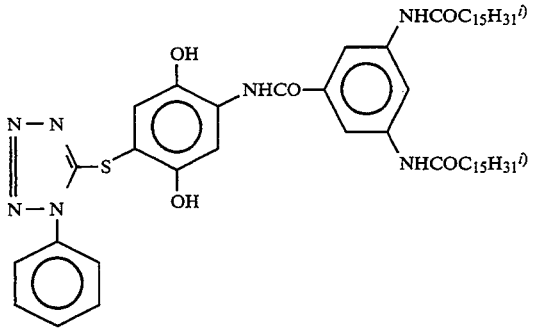
Electron transfer precursor (1)
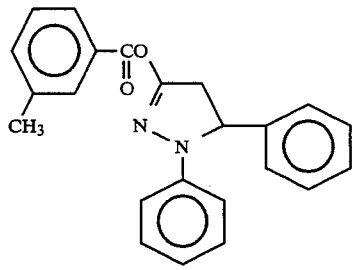
Fog inhibitor (1)

TABLE 1-continued

| Phase | Component | Cyan (g) | Magenta (g) | Yellow (g) | Electron donor (g) |
|---|---|---|---|---|---|

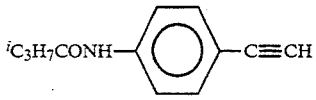

Ultraviolet absorbent (1)

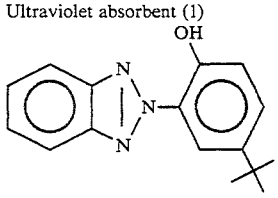

Ultraviolent absorbent (2)

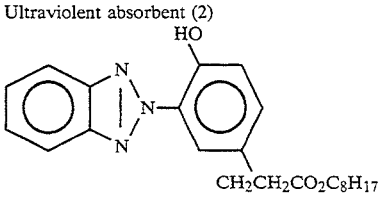

High boiling solvent (1)

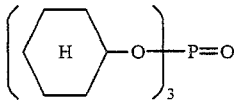

High boiling solvent (2)

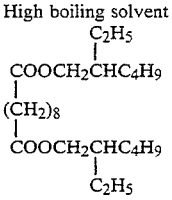

High boiling (3)

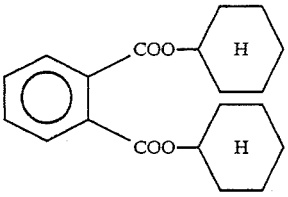

High boiling solvent (4)

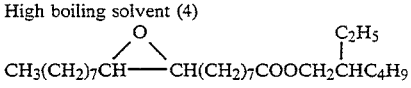

Anionic surface active agent (2)

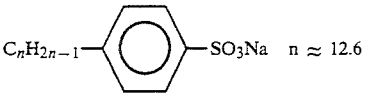

A process for the preparation of a light-sensitive silver halide emulsion will be described below.

Light-Sensitive Silver Halide Emulsion (1) (for Red-Sensitive Emulsion Layer)

To an aqueous solution of gelatin (obtained by dissolving 20 g of gelatin, 0.5 g of potassium bromide, 3 g of sodium chloride and 30 mg of a silver halide solvent (1) in 480 ml of water, kept at a temperature of 45° C.) were added simultaneously Solution (I) and Solution (II) set forth in Table 2 at the same flow rate with vigorous stirring for 20 minutes. After 5 minutes, to the emulsion were then added simultaneously Solution (III) and Solution (IV) set forth in Table 2 at the same flow rate for 25 minutes. When 10 minutes passed after the beginning of the addition of Solution (III) and Solution (IV), an aqueous solution of a gelatin dispersion of dye (obtained by dissolving 1 g of gelatin, 70 mg of dye (1), 139 mg of dye (2) and 5 mg of dye (3) in 105 ml of water, kept at a temperature of 45° C.) was added to the emulsion in 20 minutes.

The emulsion was then rinsed and desalted by an ordinary method. To the emulsion was then added 22 g of lime-treated osein gelatin so that the pH value and the pAg value thereof were adjusted to 6.2 and 7.7, respectively. To the emulsion were 4.1 mg of sodium thiosulfate, 250 mg of 4-hydroxy-6-methyl-1,3,3a,7-tetrazaindene, and 1.8 mg of chloroauric acid. The emulsion was subjected to optimum chemical sensitization at a temperature of 60° C. To the emulsion was then added 200 mg of a fog inhibitor (3). The emulsion was then cooled to obtain 635 g of a monodisperse emulsion of cubic silver bromochloride grains having an average grain size of 0.30 μm.

TABLE 2

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 250 ml | 250 ml | 200 ml | 200 ml |

Silver halide solvent (1)

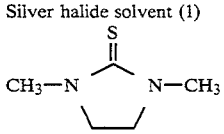

Fog inhibitor (3)

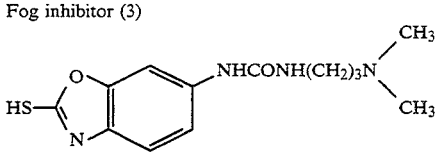

Dye (1)

TABLE 2-continued

| | Solution (I) | Solution (II) | Solution (III) | Solution (IV) |
|---|---|---|---|---|

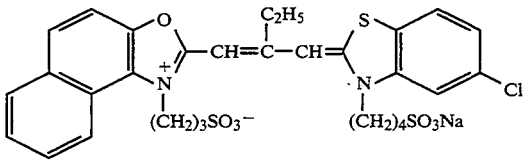

Dye (2)

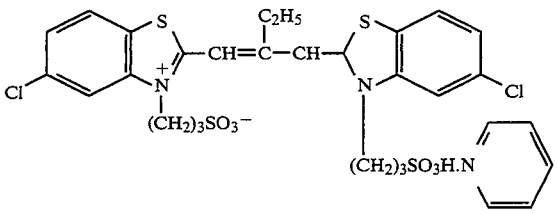

Dye (3)

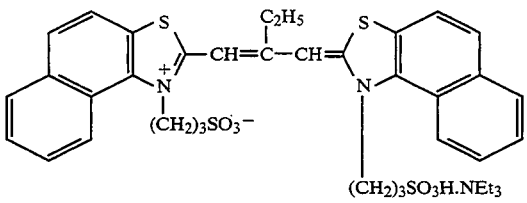

Light-Sensitive Silver Halide Emulsion (2) (for Red-Sensitive Emulsion Layer)

To an aqueous solution of gelatin (obtained by dissolving 20 g of gelatin, 0.5 g of potassium bromide, 6 g of sodium chloride and 30 mg of silver halide solvent (1) in 783 ml of water, kept at a temperature of 65° C.) were added simultaneously Solution (I) and Solution (II) set forth in Table 3 at the same flow rate for 30 minutes with vigorous stirring. After 5 minutes, to the emulsion were then added simultaneously Solution (III) and Solution (IV) set forth in Table 3 at the same flow rate for 15 minutes. When 2 minutes passed after the beginning of the addition of Solution (III) and Solution (IV), an aqueous solution of a gelatin dispersion of dye (obtained by dissolving 0.9 g of gelatin, 76 mg of the foregoing dye (1), 150 mg of the foregoing dye (2) and 5 mg of the foregoing dye (3) in 95 ml of water, kept at a temperature of 50° C.) was added to the emulsion in 18 minutes.

The emulsion was then rinsed and desalted by an ordinary method. To the emulsion was then added 22 g of lime-treated osein gelatin so that the pH value and the pAg value thereof were adjusted to 6.2 and 7.8, respectively. To the emulsion were added 2.8 mg of sodium thiosulfate, 175 mg of 4-hydroxy-6-methyl-1,3,3a,7-tetrazaindene, and 1.2 mg of chloroauric acid. The emulsion was subjected to optimum chemical sensitization at a temperature of 60° C. To the emulsion was then added 163 mg of fog inhibitor (2). The emulsion was then cooled to obtain 635 g of a monodisperse emulsion of cubic silver bromochloride grains having an average grain size of 0.50 μm.

TABLE 3

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 200 ml | 140 ml | 145 ml | 155 ml |

Fog inhibitor (2)

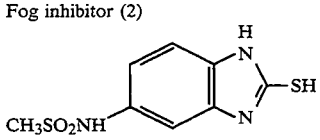

Light-Sensitive Silver Halide Emulsion (3) (for Green-Sensitive Emulsion Layer)

To an aqueous solution of gelatin (obtained by dissolving 20 g of gelatin, 0.5 g of potassium bromide, 4 g of sodium chloride and 15 mg of the foregoing silver halide solvent (1) in 690 ml of water, kept at a temperature of 48° C.) were added simultaneously Solution (I) and Solution (II) set forth in Table 4 at the same flow rate for 8 minutes with vigorous stirring. After 10 minutes, to the emulsion were then added simultaneously Solution (III) and Solution (IV) set forth in Table 4 at the same flow rate for 32 minutes. When 1 minute passed after the beginning of the addition of Solution (III) and Solution (IV), an aqueous solution of a gelatin dispersion of dye (obtained by dissolving 2.5 g of gelatin, and 250 mg of dye (4) in 100 ml of water, kept at a temperature of 45° C.) was added to the emulsion collectively.

The emulsion was then rinsed and desalted by an ordinary method. To the emulsion was then added 20 g of lime-treated osein gelatin so that the pH value and the pAg value thereof were adjusted to 6.0 and 7.6, respectively. To the emulsion were added 9.4 mg of sodium thiosulfate and 263 mg of 4-hydroxy-6-methyl-1,3,3a,7-tetrazaindene. The emulsion was subjected to optimum chemical sensitization at a temperature of 68° C. To the emulsion was then added 163 mg of the foregoing fog inhibitor (2). The emulsion was then cooled to obtain 635 g of a monodisperse emulsion of cubic silver bromochloride grains having an average grain size of 0.27 μm.

TABLE 4

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.51 g |
| Water to make | 110 ml | 110 ml | 245 ml | 245 ml |

Dye (4)

TABLE 4-continued

| Solution (I) | Solution (II) | Solution (III) | Solution (IV) |
|---|---|---|---|

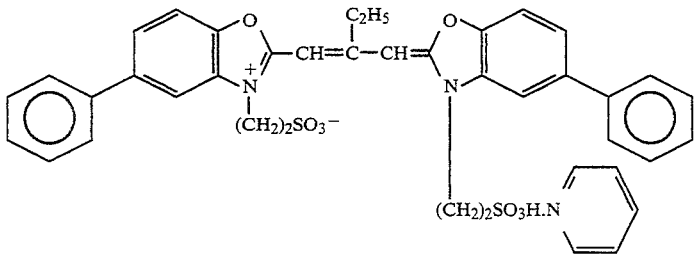

Light-Sensitive Silver Halide Emulsion (4) (for Green-Sensitive Emulsion Layer)

To an aqueous solution of gelatin (obtained by dissolving 20 g of gelatin, 0.3 g of potassium bromide, 6 g of sodium chloride and 15 mg of the foregoing silver halide solvent (1) in 700 ml of water, kept at a temperature of 55° C.) were added simultaneously Solution (I) and Solution (II) set forth in Table 5 at the same flow rate for 20 minutes with vigorous stirring. After 10 minutes, to the emulsion were then added simultaneously Solution (III) and Solution (IV) set forth in Table 5 at the same flow rate for 20 minutes. When 1 minute passed after the beginning of the addition of Solution (III) and Solution (IV), an aqueous solution of a gelatin dispersion of dye (obtained by dissolving 1.8 g of gelatin, and 180 mg of the foregoing dye (4) in 95 ml of water, kept at a temperature of 45° C.) was added to the emulsion collectively.

The emulsion was then rinsed and desalted by an ordinary method. To the emulsion was then added 20 g of lime-treated osein gelatin so that the pH value and the pAg value thereof were adjusted to 6.0 and 7.6, respectively. To the emulsion were added 1.0 mg of sodium thiosulfate, 46 mg of 4-hydroxy-6-methyl-1,3,3a,7-tetrazaindene, and 0.6 mg of chloroauric acid. The emulsion was subjected to optimum chemical sensitization at a temperature of 68° C. To the emulsion was then added 163 mg of the foregoing fog inhibitor (2). The emulsion was then cooled to obtain 635 g of a monodisperse emulsion of cubic silver bromochloride grains having an average grain size of 0.45 μm.

TABLE 5

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.38 g | — |
| KBr | — | 9.80 g | — | 44.80 g |
| NaCl | — | 2.06 g | — | 5.51 g |
| Water to make | 165 ml | 165 ml | 205 ml | 205 ml |

Light-Sensitive Silver Halide Emulsion (5) (for Blue-Sensitive Emulsion Layer)

To an aqueous solution of gelatin (obtained by dissolving 20 g of gelatin, 0.5 g of potassium bromide, 5 g of sodium chloride and 15 mg of the foregoing silver halide solvent (1) in 690 ml of water, kept at a temperature of 51° C.) were added simultaneously Solution (I) and Solution (II) set forth in Table 6 at the same flow rate for 8 minutes with vigorous stirring. After 10 minutes, to the emulsion were then added simultaneously Solution (III) and Solution (IV) set forth in Table 6 at the same flow rate for 32 minutes. When 1 minute passed after the beginning of the addition of Solution (III) and Solution (IV), an aqueous solution of a dye (obtained by dissolving 220 mg of dye (5), and 110 mg of dye (6) in a mixture of 95 ml of water and 5 ml of methanol, kept at a temperature of 45° C.) was added to the emulsion collectively.

The emulsion was then rinsed and desalted by an ordinary method. To the emulsion was then added 22 g of lime-treated osein gelatin so that the pH value and the pAg value thereof were adjusted to 6.0 and 7.8, respectively. To the emulsion were added 4.8 mg of sodium thiosulfate and 250 mg of 4-hydroxy-6-methyl-1,3,3a,7-tetrazaindene. The emulsion was subjected to optimum chemical sensitization at a temperature of 68° C. To the emulsion were then added 163 mg of the foregoing fog inhibitor (2) and 94 mg of potassium iodide. The emulsion was then cooled to obtain 635 g of a monodisperse emulsion of cubic silver bromochloride grains having an average grain size of 0.30 μm.

TABLE 6

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.52 g |
| Water make | 110 ml | 110 ml | 240 ml | 240 ml |

Dye (5)

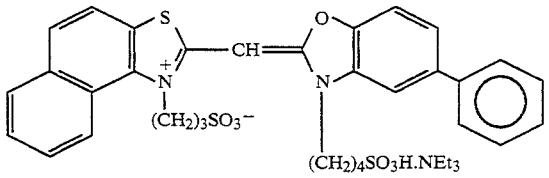

Dye (6)

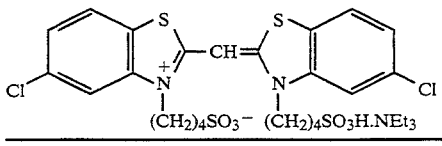

Light-Sensitive Silver Halide Emulsion (6) (for Blue-Sensitive Emulsion Layer)

To an aqueous solution of gelatin (obtained by dissolving 20 g of gelatin, 0.3 g of potassium bromide, 9 g of sodium chloride and 15 mg of the foregoing silver halide solvent (1) in 695 ml of water, kept at a temperature of 63° C.) were added simultaneously Solution (I)

and Solution (II) set forth in Table 7 at the same flow rate for 10 minutes with vigorous stirring. After 10 minutes, to the emulsion were then added simultaneously Solution (III) and Solution (IV) set forth in Table 7 at the same flow rate for 30 minutes. When 1 minute passed after the beginning of the addition of Solution (III) and Solution (IV), an aqueous solution of a dye (obtained by dissolving 155 mg of the foregoing dye (5) and 78 mg of the foregoing dye (6) in a mixture of 66 ml of water and 4 ml of methanol, kept at a temperature of 60° C.) was added to the emulsion collectively.

The emulsion was then rinsed and desalted by an ordinary method. To the emulsion was then added 22 g of lime-treated osein gelatin so that the pH value and pAg value thereof were adjusted to 6.0 and 7.8, respectively. To the emulsion were added 1.6 mg of sodium thiosulfate, 95 mg of 4-hydroxy-6-methyl-1,3,3a,7-tetrazaindene, and 0.31 mg of chloroauric acid. The emulsion was subjected to optimum chemical sensitization at a temperature of 68° C. To the emulsion were then added the foregoing fog inhibitor (2) and 94 mg of potassium iodide. The emulsion was then cooled to obtain 635 g of a monodisperse emulsion of cubic silver bromochloride grains having an average grain size of 0.55 μm.

TABLE 7

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| Water to make | 120 ml | 120 ml | 225 ml | 225 ml |

The foregoing materials were used to prepare a photographic light-sensitive material specimen D101 as set forth in Table 8.

TABLE 8

Constitution of photographic light-sensitive material specimen D101

| Layer No. | Layer name | Additive | Coated amount (mg/m²) |
|---|---|---|---|
| 7th layer | Protective layer II | Acid-treated gelatin | 340 |
| | | PMMA latex (size: 3 μm) | 20 |
| | | Colloidal silver | 0.7 |
| | | Anionic surface active agent (1) | 16 |
| | | Anionic surface active agent (3) | 2.2 |
| 6th layer | Protective layer I | Gelation | 410 |
| | | Zinc hydroxide | 440 |
| | | Electron donor (2) | 75 |
| | | Inhibitor-releasing precursor (1) | 14 |
| | | High boiling solvent (3) | 16 |
| | | High boiling solvent (4) | 16 |
| | | Anionic surface active agent (1) | 4 |
| | | Dextran | 16 |
| | | Water-soluble polymer (1) | 1.4 |
| | | Polymer latex (1) | 66 |
| | | Nonionic surface active agent (1) | 28 |
| | | Anionic surface active agent (2) | 4.5 |
| 5th layer | Blue-sensitive emulsion layer | Light-sensitive silver halide emulsion (5) | 315 as silver |
| | | Light-sensitive silver halide emulsion (6) | 95 as silver |

TABLE 8-continued

Constitution of photographic light-sensitive material specimen D101

| | | | |
|---|---|---|---|
| | | Yellow dye-providing compound (1) | 380 |
| | | Gelatin | 520 |
| | | Electron donor (1) | 132 |
| | | Electron transfer precursor (1) | 25 |
| | | Fog inhibitor (1) | 11.7 |
| | | High boiling solvent (1) | 152 |
| | | High boiling solvent (2) | 114 |
| | | Anionic surface active agent (2) | 44 |
| | | Fog inhibitor (2) | 0.9 |
| | | Water-soluble polymer (1) | 11 |
| 4th layer | Interlayer | Gelatin | 550 |
| | | Electron donor (2) | 159 |
| | | Electron donor (3) | 30 |
| | | High boiling solvent (3) | 34 |
| | | High boiling solvent (4) | 34 |
| | | Anionic surface active agent (2) | 5.1 |
| | | Electron transfer agent (1) | 78 |
| | | Water-soluble polymer (4) | 38 |
| | | Hardener (1) | 36 |
| | | Amphoteric surface active agent (1) | 26 |
| | | Water-soluble polymer (1) | 10 |
| 3rd layer | Green-sensitive emulsion layer | Light-sensitive silver halide emulsion (3) | 250 as silver |
| | | Light-sensitive silver halide emulsion (4) | 100 as silver |
| | | Magenta dye-providing compound (1) | 359 |
| | | Gelatin | 430 |
| | | Electron donor (1) | 130 |
| | | Electron transfer agent precursor (1) | 33 |
| | | Fog inhibitor (1) | 10 |
| | | Ultraviolet absorbent (1) | 45 |
| | | Ultraviolet absorbent (2) | 45 |
| | | High boiling solvent (1) | 45 |
| | | High boiling solvent (3) | 135 |
| | | Anionic surface active agent (2) | 8 |
| | | Fog inhibitor (1) | 0.8 |
| | | Water-soluble polymer (1) | 13 |
| 2nd layer | Interlayer | Gelatin | 760 |
| | | Zinc hydroxide | 812 |
| | | Electron donor (2) | 139 |
| | | Electron donor (3) | 26 |
| | | High boiling solvent (3) | 29 |
| | | High boiling solvent (4) | 29 |
| | | Anionic sSurface active agent (2) | 4.5 |
| | | Anionic surface active agent (1) | 5 |
| | | Water-soluble polymer (4) | 29 |
| | | Water-soluble polymer (1) | 3.0 |
| | | Polymer latex (1) | 122 |
| | | Nonionic surface active agent (1) | 54 |
| 1st layer | Red-sensitive emulsion layer | Light-sensitive silver halide emulsion (1) | 108 as silver |
| | | Light-sensitive silver halide emulsion (2) | 60 as silver |
| | | Cyan dye-providing compound (1) | 185 |
| | | Cyan dye-providing compound (2) | 127 |
| | | Gelatin | 580 |
| | | Electron donor (1) | 100 |
| | | Electron transfer agent precursor (1) | 29 |
| | | Fog inhibitor (1) | 8.2 |
| | | Ultraviolet absorbent (1) | 31 |
| | | Ultraviolet absorbent (2) | 31 |
| | | High boiling solvent (1) | 39 |
| | | High boiling solvent (3) | 117 |
| | | Anionic surface active agent (2) | 21 |
| | | Anionic surface active | 21 |

TABLE 8-continued

| Constitution of photographic light-sensitive material specimen D101 | |
|---|---|
| agent (3) | |
| Fog inhibitor (2) | 0.2 |
| Fog inhibitor (3) | 0.3 |
| Water-soluble polymer (1) | 7 |

Support (1) Paper support laminated with polyethylene (thickness: 131 μm)

Support (1)

| Layer name | Composition | Layer thickness (μm) |
|---|---|---|
| Surface undercoating layer | Gelatin | 0.1 |
| Surface PE layer (glossy) | Low density polyethylene (density: 0.923): 89.2 parts<br>Surface-treated titanium oxide: 10.0 parts<br>Ultramarine: 0.8 parts | 36.0 |
| Pulp layer | Woodfree paper (LBKP/NBKP = 1/1; density: 1.080) | 64.0 |
| Back PE layer (matte) | High density polyethylene (density: 0.960) | 31.0 |
| Back undercoating layer | Gelatin<br>Colloidal silica | 0.05<br>0.05 |
| | | 131.2 |

Water-soluble Polymer (1)

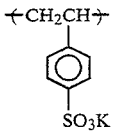

Polymer latex (2)

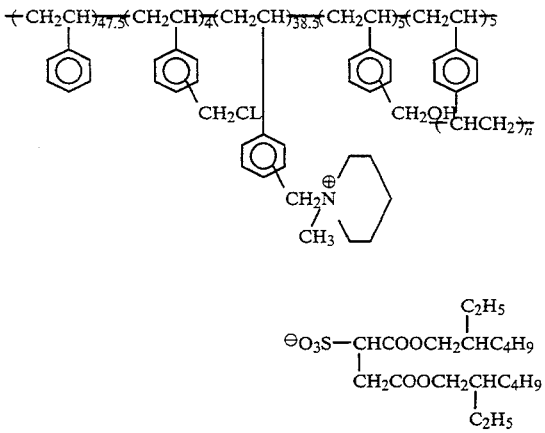

Hardener (1)

$CH_2{=}CHSO_2CH_2SO_2CH{=}CH_2$

A process for the preparation of an image-receiving material will be described below.

25 g of fluororescent brightening agent (1), 32 g of stain inhibitor (1), 10 g of the foregoing anionic surface active agent (1), and 10 g of anionic surface active agent (5) were dissolved in a mixtue of 690 g of a high boiling solvent (3) and 250 ml of ethyl acetate. The solution was then added to 1,200 ml of a 25% aqueous solution of gelatin. The mixture was then subjected to dispersion at 1,250 rpm by means of a homogenizer for 20 minutes. To the dispersion was then added 300 ml of water with stirring to obtain a homogeneous dispersion.

A process for the preparation of a latex dispersion will be described below.

20 g of gelatin and 30 g of water-soluble polymer (4) were dissolved in 200 ml of water at a temperature of 50° C. The solution was then cooled to a temperature of 40° C. To the solution was then added 117 g of polymer latex (1) with stirring. The mixture was then filtrated through a 30-μm filter in the form of solution to obtain a homogeneous dispersion.

Image-receiving material R101 having the constitution set forth in Table 9 was prepared. Image-receiving paper material R201 having the constitution set forth in Table 10 on a support set forth in Table 11 was prepared in the same manner as in R101.

TABLE 9

Constitution of image-receiving material R101

| Layer No. | Additive | Coated amount ($mg/m^2$) |
|---|---|---|
| 3rd layer | Water-soluble polymer (3) | 58 |
| | Water-soluble polymer (2) | 239 |
| | Guanidine picolate | 450 |
| | Anionic surface active agent (1) | 10 |
| | Anionic surface active agent (3) | 26 |
| | Amphoteric surface active agent (4) | 100 |
| 2nd layer | Gelatin | 1,360 |
| | High boiling solvent (5) | 1,330 |
| | Fluorescent brightening agent (1) | 53 |
| | Stain inhibitor (3) | 63 |
| | Nonionic surface active agent (1) | 17 |
| | Anionic surface active agent (2) | 23 |
| | Mordant (1) | 2,350 |
| | Water-soluble polymer (4) | 610 |
| | Water-soluble polymer (2) | 210 |
| | Guanidine picolate | 2,360 |
| 1st layer | Gelatin | 490 |
| | Water-soluble polymer (2) | 40 |
| | Amphoteric surface active agent (1) | 11 |
| | Hardener (2) | 340 |

Support (2) Paper support laminated with polyethylene (thickness: 170 μm)

| | | |
|---|---|---|
| 1st backing layer | Gelatin | 2,950 |
| | Water-soluble polymer (1) | 40 |
| | Hardener (2) | 125 |
| 2nd backing layer | Gelatin | 430 |
| | Water-soluble polymer (3) | 80 |
| | Anionic surface active agent (3) | 45 |
| | Anionic surface active agent (4) | 10 |
| | Water-soluble polymer (1) | 3 |
| | Matting agent (1) | 30 |

Support (2)

| Layer name | Composition | Layer thickness (μm) |
|---|---|---|
| Surface undercoating layer | Gelatin | 0.1 |
| Surface PE layer (glossy) | Low density polyethylene (density: 0.923): 89.2 parts<br>Surface-treated titanium oxide: 10.0 parts<br>Ultramarine: 0.8 parts | 35.0 |
| Pulp layer | Woodfree (LBKP/NBKP = 1/1; density: 1.080) | 106.2 |
| Back PE layer (matte) | High density polyethylene (density: 0.960) | 30.0 |
| Back undercoating layer | Gelatin<br>Colloidal silica | 0.05<br>0.05 |
| | | 170.0 |

Water-soluble polymer (2): Sumikagel L5-H (available from Sumitomo Chemical Co., Ltd.)

Water-soluble polymer (3): κ Carageenan (available from Taito Co., Ltd.)

Water-soluble polymer (4): Dextran (molecular weight:

TABLE 9-continued

Constitution of image-receiving material R101

70,000)

Surface active agent (6)

Amphoteric surface active agent (1)

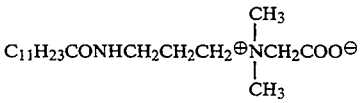

Anionic surface active agent (4)

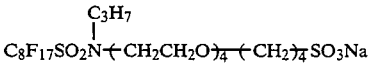

High boiling solvent (3)

$C_{26}H_{46.9}Cl_{7.1}$ (Emapara 40, available from Ajinomoto Co., Inc.)

Fluorescent brightening agent (1)

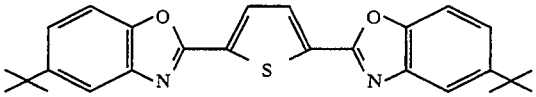

Stain inhibitor (1)

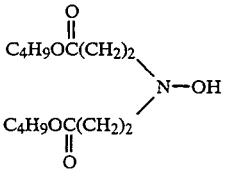

Mordant (1)

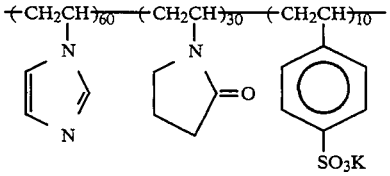

Mordant (2)

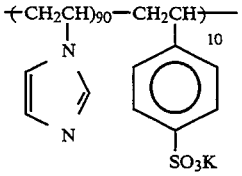

Hardener (2)

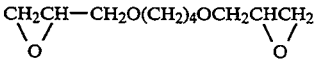

Hardener (3)

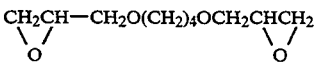

Polymer latex (3)

Nipol LX814 (available from Nihon Zeon K.K.)

Matting agent (1)

Benzoguanamine resin (average grain diameter: 15 μm)

Matting agent (2)

SYLOID79 (available from Fuji Davison Kagaku K.K.)

Matting agent (3)

PMMA latex (average grain diameter: 4.5 μm)

TABLE 10

Constitution of image-receiving material R201

| Layer No. | Additive | Coated amount ($mg/m^2$) |
|---|---|---|
| 4th layer | Water-soluble polymer (2) | 200 |
| | Water-soluble polymer (3) | 60 |
| | Potassium nitrate | 30 |
| | Anionic surface active agent (1) | 8 |
| | Anionic surface active agent (3) | 7 |
| | Matting agent (2) | 10 |
| 3rd layer | Gelatin | 250 |
| | Water-soluble polymer (2) | 30 |
| | Amphoteric surface active agent (1) | 27 |
| | Hardener (2) | 190 |
| 2nd layer | Gelatin | 1,400 |
| | Water-soluble polymer (2) | 130 |
| | Water-soluble polymer (4) | 660 |
| | Polymer latex (3) | 1,180 |
| | High boiling solvent (5) | 690 |
| | Fluorescent brightening agent (1) | 25 |
| | Mordant (1) | 2,350 |
| | Anionic surface active agent (1) | 10 |
| | Guanidine picolate | 2,900 |
| | Stain inhibitor (1) | 32 |
| 1st layer | Gelatin | 190 |
| | Water-soluble polymer (2) | 10 |
| | Anionic surface active agent (1) | 10 |
| | Amphoteric surface active agent (1) | 27 |
| | Hardener (2) | 190 |

Support (3) Paper support laminated with polyethylene (thickness: 206 μm)

The coated amount of polymer latex (3) is represented in terms of latex solid content.

Support (3)

| Layer name | Composition | Layer thickness (μm) |
|---|---|---|
| Surface undercoating layer | Gelatin | 0.1 |
| Surface PE layer (glossy) | Low density polyethylene (density 0.923): 89.2 parts<br>Surface-treated titanium oxide: 10.0 parts<br>Ultramarine: 0.8 parts | 35.0 |
| Pulp layer | Woodfree paper (LBKP/NBKP = 1/1; density: 1.080) | 140.8 |
| Back PE layer (matte) | High density polyethylene (density: 0.960) | 30.0 |
| Back undercoating layer | Gelatin<br>Colloidal silica | 0.05<br>0.05 |
| | | 206.0 |

Further, image-receiving materials R102 to R120 were prepared in the same manner as R101 except that the matting agents as set forth in Table A below were incorporated in the layers specified in Table A in an amount set forth in Table A, respectively, and the amount of gelatin to be incorporated in the 1st layer in R110 and R117 to R119 were 200/490 and 900/490 of that in R101, respectively. Moreover, image-receiving materials R202 to R220 were prepared in the same manner as R201 except that besides the matting agent (2) to be incorporated in the 4th layer as set forth in Table 10 the matting agents as set forth in Table B below were incorporated in the layers specified in Table B in an amount set forth in Table B, respectively, and the amount of gelatin to be incorporated in the 1st layer in R217 to R219 were 900/190 of that in R201, respectively.

The kind of the matting agents is represented by the kind of the material and average grain diameter of grains. The layer in which the matting agent is incorporated is represented by the name of layer set forth in Tables 9 and 10. The amount of the matting agent to be incorporated is represented by gram as calculated in terms of solid content per $m^2$. Referring to the matting agent incorporated in the 1st layer, the ratio of the thickness of the 1st layer to the average grain diameter of the matting agent is represented by "thickness/grain diameter" in the tables. The thickness of the 1st layer excluding the matting agent is about 0.50 μm for R101 to R109, R111 to R116, and R120, about 0.21 μm for R110, about 0.91 μm for R117 to R119, about 0.20 μm for R201 to R216, and R220, about 0.91 μm for R217 to 219.

The foregoing photographic light-sensitive materials and image-receiving materials were then processed by means of an image recording apparatus described in JP-A-2-84634.

In some detail, the photographic light-sensitive material specimens each was subjected to scanning exposure to a full color original through a slit. The photographic light-sensitive material specimens thus exposed each was dipped in water kept at a temperature of 40° C. for 2.5 seconds, squeezed between rollers, and then immediately laminated on the image-receiving material in such an arrangement that the emulsion side thereof were brought into contact with each other. The laminate was then heated for 17 seconds over a heat drum which had been adjusted such that the temperature of the water-absorbed emulsion surface thereof reached 80° C. Subsequently, the photographic light-sensitive material was peeled from the image-receiving material. As a result, a sharp color image corresponding to the original was formed on the image-receiving material.

The gloss of the image was measured by means of a digital gonioglossmeter UGH-5D available from Suga Shikenki K.K. The results (gloss at 20°) are set forth in Tables A, B and C. When the gloss is less than 15, non-gloss surface is given. When the gloss is not more than 6, a so-called deep matte (glossless surface) is given. The dark area on the image was measured for density by means of a reflective densitometer. The results are set forth in the tables as transfer density. Further, evaluation was made on texture by which the image is seen as if it is covered white. Mark "x" indicates the condition under which the image is shown as if it is covered white. Mark "O" indicates an excellent condition. Moreover, a visual evaluation was made on the uniformity in the transferred image. The results are set forth in the tables as "transferability". Mark "O" indicates the condition under which the image is seen uniformly. Mark "Δ" indicates the condition under which the image somewhat lacks uniformity but still can be regarded as an image. Mark "x" indicates the condition under which the image has a problem regarding uniformity.

TABLE A

| Image receiving material | Matting agent (average grain diameter) | Incorporated in | Added amount ($g/m^2$) | Thickness/ grain diameter | Gloss | Transfer density | Texture | Transfer-ability |
|---|---|---|---|---|---|---|---|---|
| 101(comparative) | — (—) | — | — | — | 76 | 1.98 | O | O |
| 102(comparative) | PMMA (6 μm) | 4th layer | 0.10 | — | 33 | 1.67 | O | O |
| 103(comparative) | PMMA (6 μm) | 4th layer | 0.20 | — | 18 | 1.52 | O | Δ |
| 104(comparative) | PMMA (6 μm) | 4th layer | 0.30 | — | 8 | 1.40 | x | x |
| 105(comparative) | PMMA (6 μm) | 4th layer | 0.50 | — | 5 | 1.31 | x | x |
| 106(comparative) | Benzoguanamine resin (17 μm) | 4th layer | 0.10 | — | 20 | 1.48 | x | x |
| 107(comparative) | Benzoguanamine resin (17 μm) | 4th layer | 0.20 | — | 9 | 1.34 | x | x |
| 108(present invention) | PMMA (1 μm) | 1st layer | 1.20 | 1.70 | 15 | 1.71 | O | O |
| 109(present invention) | PMMA (3 μm) | 1st layer | 0.90 | 0.47 | 13 | 1.70 | O | O |
| 110(present invention) | PMMA (10 μm) | 1st layer | 0.60 | 0.08 | 12 | 1.67 | O | Δ |
| 111(present invention) | PMMA (4 μm) | 1st layer | 1.20 | 0.43 | 9 | 1.65 | O | O |
| 112(present invention) | PMMA (6 μm) | 1st layer | 0.90 | 0.23 | 10 | 1.67 | O | O |
| 113(present invention) | PMMA (10 μm) | 1st layer | 0.60 | 0.11 | 11 | 1.66 | O | O |
| 114(present | PMMA (6 μm) | 1st layer | 1.20 | 0.28 | 7 | 1.62 | O | O |
| 115(present invention) | Silicon dioxide (3 μm) | 1st layer | 0.90 | 0.47 | 9 | 1.64 | O | O |
| 116(present invention) | Silicon dioxide (6 μm) | 1st layer | 1.20 | 0.43 | 7 | 1.60 | O | O |
| 117(present invention) | Silicon dioxide (3 μm) | 1st layer | 0.90 | 0.60 | 11 | 1.67 | O | O |
| 118(present invention) | PMMA (4 μm) | 1st layer | 1.20 | 0.53 | 13 | 1.69 | O | O |
| 119(present invention) | Benzoguanamine resin (17 μm) | 1st layer | 0.90 | 0.11 | 8 | 1.66 | O | Δ |
| 120(present | Benzoguanamine | 1st layer | 1.20 | 0.10 | 7 | 1.60 | O | Δ |

TABLE B

| Image receiving material | Matting agent (average grain diameter) | Incorporated in | Added amount (g/m²) | Thickness/ grain diameter | Gloss | Transfer density | Texture | Transfer-ability |
|---|---|---|---|---|---|---|---|---|
| 201(comparative) | — (—) | — | — | — | 84 | 2.20 | O | O |
| 202(comparative) | PMMA (6 μm) | 4th layer | 0.10 | — | 32 | 1.93 | O | O |
| 203(comparative) | PMMA (6 μm) | 4th layer | 0.20 | — | 19 | 1.78 | O | Δ |
| 204(comparative) | PMMA (6 μm) | 4th layer | 0.30 | — | 9 | 1.66 | x | Δ |
| 205(comparative) | PMMA (6 μm) | 4th layer | 0.50 | — | 6 | 1.58 | x | x |
| 206(comparative) | Benzoguanamine resin (17 μm) | 4th layer | 0.10 | — | 19 | 1.73 | x | Δ |
| 207(comparative) | Benzoguanamine resin (17 μm) | 4th layer | 0.20 | — | 10 | 1.58 | x | x |
| 208(present invention) | PMMA (1 μm) | 1st layer | 1.20 | 1.40 | 15 | 1.93 | O | O |
| 209(present invention) | PMMA (3 μm) | 1st layer | 0.90 | 0.30 | 14 | 1.92 | O | O |
| 210(present invention) | PMMA (10 μm) | 1st layer | 0.60 | 0.08 | 11 | 1.88 | O | Δ |
| 211(present invention) | PMMA (4 μm) | 1st layer | 1.20 | 0.35 | 8 | 1.84 | O | O |
| 212(present invention) | PMMA (6 μm) | 1st layer | 0.90 | 0.18 | 11 | 1.87 | O | O |
| 213(present invention) | PMMA (10 μm) | 1st layer | 0.90 | 0.11 | 9 | 1.88 | O | O |
| 214(present invention) | PMMA (6 μm) | 1st layer | 1.20 | 0.23 | 6 | 1.85 | O | O |
| 215(present invention) | Silicon dioxide (3 μm) | 1st layer | 0.90 | 0.37 | 10 | 1.85 | O | O |
| 216(present invention) | Silicon dioxide (6 μm) | 1st layer | 1.20 | 0.23 | 8 | 1.82 | O | O |
| 217(present invention) | Silicon dioxide (3 μm) | 1st layer | 0.90 | 0.60 | 11 | 1.86 | O | O |
| 218(present invention) | PMMA (4 μm) | 1st layer | 1.20 | 0.53 | 12 | 1.87 | O | O |
| 219(present invention) | Benzoguanamine resin (17 μm) | 1st layer | 0.90 | 0.11 | 8 | 1.88 | O | Δ |
| 220(present invention | Benzoguanamine resin (17 μm) | 1st layer | 1.20 | 0.10 | 5 | 1.81 | O | Δ |

As can be seen in Table A, the dye fixing materials comprising compounds according to the present invention satisfy the requirement for matte surface, i.e., low gloss, texture that prevents the surface from being seen covered white, and uniformity in transferred image as compared with Comparative Examples 101 to 107. In some detail, Comparative Examples 101 to 107, which are examples of the structure comprising a matting agent in the surface protective layer, exhibit a decreasing gloss and provide a better matte surface with the increase in the added amount of the matting agent. It can also be seen that the larger the grain diameter of the matting agent used is, the less is the added amount required to provide good matte properties. However, it can be seen, at the same time, that the greater the added amount of the matting agent is, the worse is transferability and hence image uniformity. It can also be seen that R104 to 107, which are examples of the structure comprising a matting agent in the surface protective layer, exhibit a deteriorated texture as well. On the other hand, it can be seen that R108 to R120, which are examples of the structure according to the present invention comprising a matting agent in a layer (1st layer) nearer to the support than the mordant layer, provide a good matte surface without deteriorating texture and transferability. Among these specimens, R108 and R109, which comprise matting agents having a grain diameter of less than 4 μm, exhibit a slightly high gloss and hence reduced matte properties. On the contrary, R119 and R120, which comprise matting agents having a grain diameter of more than 15 μm, exhibit a slightly worse transferability. It can also be seen that R110, which has a thickness/grain diameter of less than 1/10, exhibits a slightly worse transferability. On the other hand, R117 and R118, which comprise a thickness/grain diameter of more than ½, exhibit a slightly increased gloss.

As can be seen in Table B, the dye fixing materials comprising compounds according to the present invention (R208 to R220) satisfy the requirement for matte surface, i.e., low gloss, texture that prevents the surface from being seen covered white, and uniformity in transferred image as compared with Comparative Examples 201 to 207 as in Table A.

The comparison of R104 in Table A with R204 in Table B and R106 in Table A with R206 in Table B shows that R204 and R206 exhibit a slight better transfer uniformity than the others. Though not shown in the evaluation tables (Tables A and B), this can apply to other image-receiving materials. The comparison of comparable specimens shows that those designated R200's exhibit a better transferability than those designated R100's. This effect, though the reason is not clearly known, is possibly the result of the combined use of the water-soluble polymers (2) and (3) and the absence of guanidine picolate in the 4th layer in the image-receiving materials designated as R200's.

EXAMPLE 2

Image-receiving materials R301 to R320 were prepared in the same manner as R201 to R220 of Example 1 except that the matting agents set forth in Table B were incorporated in the st layer or 4th layer as set forth in Table 11. These specimens were then processed and evaluated in the same manner as in Example 1. The results were almost the same as those of Example 1.

TABLE 12

| Constitution of image-receiving material R301 | | |
|---|---|---|
| Layer No. | Additive | Coated amount ($mg/m^2$) |
| 4th layer | Water-soluble polymer (2) | 200 |
| | Water-soluble polymer (3) | 60 |
| | Potassium nitrate | 30 |
| | Anionic surface active agent (1) | 8 |
| | Anionic surface active agent (3) | 7 |
| | Matting agent (3) | 10 |
| 3rd layer | Gelatin | 250 |
| | Water-soluble polymer (2) | 30 |
| 2nd layer | Gelatin | 700 |
| | Water-soluble polymer (2) | 130 |
| | Water-soluble polymer (4) | 660 |
| | Latex dispersion (3) | 1,180 |
| | High boiling solvent (5) | 690 |
| | Fluorescent brightening agent (1) | 25 |
| | Mordant (2) | 2,350 |
| | Anionic surface active agent (1) | 10 |
| | Guanidine picolate | 2,900 |
| | Stain inhibitor (1) | 32 |
| 1st layer | Gelatin | 190 |
| | Water-soluble polymer (2) | 10 |
| | Anionic surface active agent (1) | 10 |
| | Hardener (3) | 380 |
| Support (3) Paper support laminated with polyethylene (thickness: 206 μm) | | |

The coated amount of the latex dispersion (3) is represented in terms of latex solid content.

EXAMPLE 3

A process for the preparation of an emulsion (7) will be described below (emulsion for 5th layer).

To an aqueous solution having the composition set forth in Table 13 were added simultaneously Solution I and Solution II having the composition set forth in Table 14 with vigorous stirring in 15 minutes. Thereafter, to the solution were added Solution III and Solution IV having the composition set forth in Table 14 in 35 minutes.

TABLE 13

| Composition | |
|---|---|
| $H_2O$ | 630 cc |
| Gelatin | 20 g |
| KBr | 0.3 g |
| NaCl | 2 g |
| Silver halide solvent (1) | 0.015 g |
| Temperature | 45° C. |

TABLE 14

| | I | II | III | IV |
|---|---|---|---|---|
| $AgNO_3$ | 30 | — | 70 | — |
| KBr (g) | — | 21 | — | 28 |
| NaCl (g) | — | 6.9 | — | 3.5 |
| Water to make (ml) | 150 | 150 | 350 | 350 |

When 18 minutes passed after the beginning of the addition of Solution III, 75 ml of a 0.5% methanol solution of a dye (7) was added to the emulsion in 25 minutes. The emulsion was then rinsed and desalted (using a precipitating agent (1) at a pH value of 4.1). The emulsion was then adjusted with 22 g of gelatin to a pH value of 6.0 and pAg value of 7.9. The emulsion was then subjected to chemical sensitization with a compound set forth in Table 15 at a temperature of 60° C. As a result, 630 g of a monodisperse emulsion of cubic grains having a grain size variation coefficient of 10.2% and an average grain size of 0.31 μm was obtained.

TABLE 15

| | Chemical sensitization |
|---|---|
| Temperature | 61° C. |
| 4-Hydroxy-6-methyl-1,3,3a,7-tetrazaindene | 0.12 g |
| Sodium thiosulfate | 6.0 mg |

Dye (7)

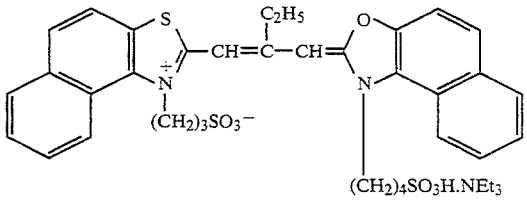

Precipitating agent (1)

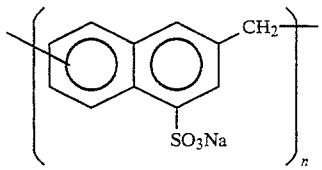

A process for the preparation of an emulsion (8) will be described below (emulsion for 3rd layer).

To an aqueous solution having the composition set forth in Table 16 were added simultaneously Solution I and Solution II having the composition set forth in Table 17 with vigorous stirring in 10 minutes. Thereafter, to the solution were added Solution III and Solution IV having the composition set forth in Table 17 in 45 minutes.

TABLE 16

| Composition | |
|---|---|
| $H_2O$ | 630 cc |
| Gelatin | 20 g |
| KBr | 0.5 g |
| NaCl | 2 g |
| Silver halide solvent (1) | 0.015 g |
| Temperature | 50° C. |

TABLE 17

| | I | II | III | IV |
|---|---|---|---|---|
| $AgNO_3$ | 30 | — | 70 | — |
| KBr (g) | — | 21 | — | 28 |
| NaCl (g) | — | 6.9 | — | 3.5 |
| Water to make (ml) | 150 | 150 | 350 | 350 |

The emulsion was then rinsed and desalted (using the precipitating agent (1) at a pH value of 3.9). The emulsion was then adjusted with 12 g of gelatin to a pH value of 5.9 and pAg value of 7.8. The emulsion was then subjected to chemical sensitization with a compound set forth in Table 18 at a temperature of 70° C. At the final stage of chemical sensitization, 42 g of a gelatin dispersion of a dye (8) (gelatin: 5%; sensitizing dye: 0.5%) was added to the emulsion. As a result, 645 g of a monodisperse emulsion of cubic grains having a grain size variation coefficient of 12.6% and an average grain size of 0.32 μm was obtained.

TABLE 18

| | Chemical sensitization |
|---|---|
| Temperature | 65° C. |
| 4-Hydroxy-6-methyl-1,3,3a,7-tetrazaindene | 0.27 g |
| Sodium thiosulfate | 3 mg |

Dye (8)

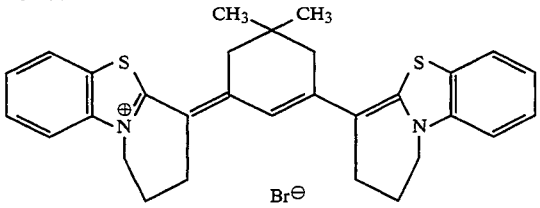

A process for the preparation of an emulsion (9) will be described below (emulsion for 1st layer).

To an aqueous solution having the composition set forth in Table 19 were added simultaneously Solution I and Solution II having the composition set forth in Table 20 with vigorous stirring in 15 minutes. Thereafter, to the solution were added Solution III and Solution IV having the composition set forth in Table 20 in 25 minutes.

TABLE 19

| Composition | |
|---|---|
| $H_2O$ | 630 cc |
| Gelatin | 20 g |
| KBr | 0.6 g |
| NaCl | 2 g |
| Silver halide solvent (1) | 0.015 g |
| Temperature | 40° C. |

TABLE 20

| | I | II | III | IV |
|---|---|---|---|---|
| $AgNO_3$ | 30 | — | 70 | — |
| KBr (g) | — | 21 | — | 28 |
| NaCl (g) | — | 6.9 | — | 3.5 |
| Water to make (ml) | 150 | 150 | 250 | 350 |

The emulsion was then rinsed and desalted (using the precipitating agent (1) at a pH value of 3.8). The emulsion was then adjusted with 20 g of gelatin to a pH value of 6.6 and pAg value of 8.0. The emulsion was then subjected to chemical sensitization with a compound set forth in Table 21 at a temperature of 58° C. At the final stage of chemical sensitization, 42 g of a gelatin dispersion of a dye (9) (gelatin: 5%; sensitizing dye: 1%) was added to the emulsion. As a result, 650 g of a monodisperse emulsion of cubic grains having a grain size variation coefficient of 9.7% and an average grain size of 0.22 μm was obtained.

TABLE 21

| | Chemical sensitization |
|---|---|
| Temperature | 58° C. |
| 4-Hydroxy-6-methyl-1,3,3a,7-tetrazaindene | 0.48 g |
| Triethylthiourea | 2.4 mg |
| Chlorauric acid | 1.0 mg |

Dye (9)

TABLE 21-continued

Chemical sensitization

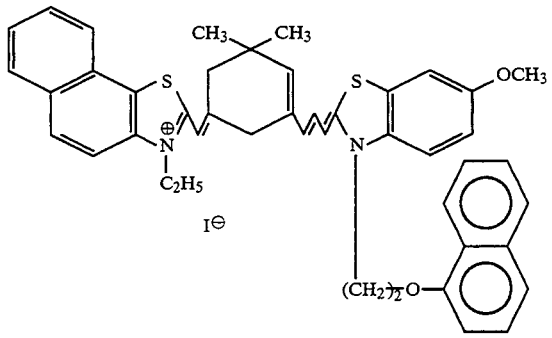

A process for the preparation of a gelatin dispersion of a dye-providing compound will be described below.

14.64 g of a magenta dye-providing compound (2) having the following structural formula, 0.8 g of a reducing agent (1) having the structural formula given below, 0.20 g of a fog inhibitor (4)having the structural formula given below, 0.4 g of the foregoing anionic surface active agent (2), and 5.1 g of the foregoing high boiling solvent (1) were measured out. These materials were mixed with 70 ml of ethyl acetate and dissolved at a temperature of about 60° C. to make a homogeneous solution. The solution thus obtained was then mixed with 71 g of a 14% aqueous solution of lime-treated gelatin and 220 ml of water with stirring. The mixture was then subjected to dispersion at 10,000 rpm for 10 minutes by means of a homogenizer. Thus, a dispersion of magenta dye-providing compound was obtained.

Magenta dye-providing compound (2)

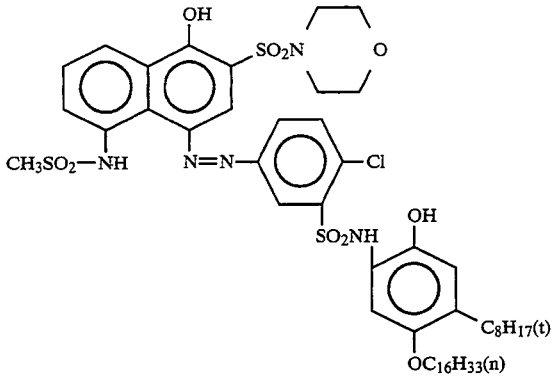

7.3 g of a cyan dye-providing compound (3) having the following structural formula, 10.6 g of a cyan dye-providing compound (4) having the following structural formula, 1.0 g of the foregoing reducing agent (1), 0.30 g of the foregoing fog inhibitor (4), 0.4 g of the foregoing anionic surface active agent (2), and 9.8 g of the foregoing high boiling solvent (2) were measured out. These materials were mixed with 40 ml of ethyl acetate and dissolved at a temperature of about 60° C. to make a homogeneous solution. The solution thus obtained was then mixed with 71 g of a 14% aqueous solution of lime-treated gelatin and 260 ml of water with stirring. The mixture was then subjected to dispersion at 10,000 rpm for 10 minutes by means of a homogenizer. Thus, a dispersion of cyan dye-providing compound was obtained.

Cyan dye-providing compound (3)

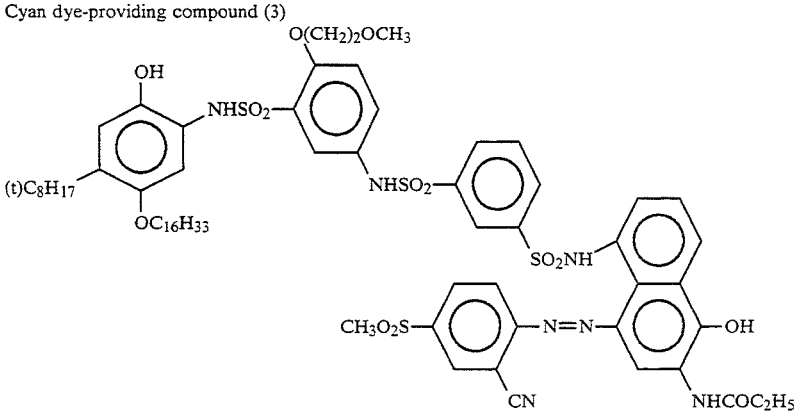

Cyan dye-providing compound (4)

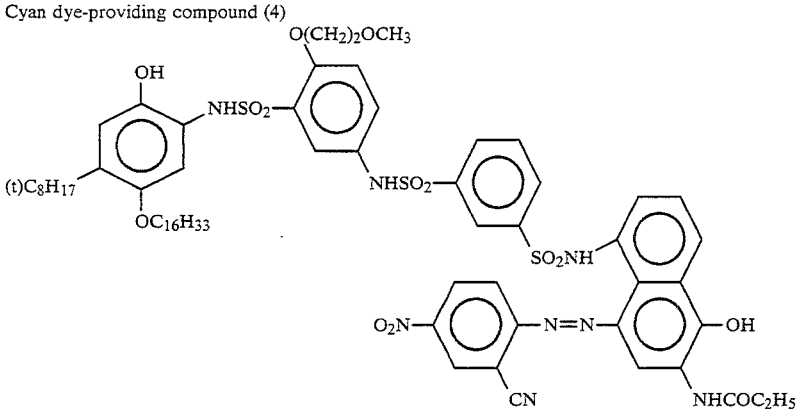

18.8 g of a yellow dye-providing compound (2) having the following structural formula, 1.0 g of the foregoing reducing agent (1), 0.13 g of the foregoing fog inhibitor (4), 1.5 g of the foregoing anionic surface active agent (2), 2.1 g of the foregoing dye (1), and 7.5 g of the foregoing high boiling solvent (2) were measured out. These materials were mixed with 45 ml of ethyl acetate and dissolved at a temperature of about 60° C. to make a homogeneous solution. The solution thus obtained was then mixed with 71 g of a 14% aqueous'solution of lime-treated gelatin and 160 ml of water with stirring. The mixture was then subjected to dispersion at 10,000 rpm for 10 minutes by means of a homogenizer. Thus, a dispersion of yellow dye-providing compound was obtained.

Yellow dye-providing compound (2)

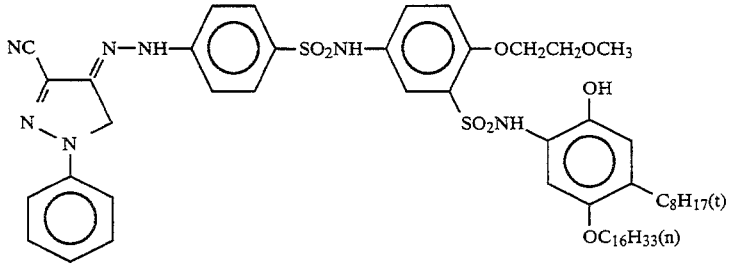

These dye-providing compounds were used to form a photographic light-sensitive material D201 having the composition set forth in Table 22.

TABLE 22

Constitution of photographic light-sensitive material D201

| Layer No. | Layer name | Additive | Coated amount (g/m$^2$) |
|---|---|---|---|
| 7th layer | Protective layer | Gelatin | 0.264 |
| | | PMMA latex (size: 3 μm) | 0.018 |
| | | $Zn(OH)_2$ | 0.964 |
| | | Anionic surface active agent (1) | 0.028 |
| | | Anionic surface active agent (3) | 0.002 |
| | | Water-soluble polymer (1) | 0.004 |
| 6th layer | Interlayer | Gelatin | 0.762 |
| | | Anionic surface active agent (1) | 0.007 |
| | | Water-soluble polymer (1) | 0.016 |
| 5th layer | Red-sensitive layer (670 nm) | Emulsion (7) | 0.205 as silver |
| | | Magenta dye-providing | 0.2845 |

TABLE 22-continued

Constitution of photographic light-sensitive material D201

| | | | |
|---|---|---|---|
| | | compound (2) | |
| | | High boiling solvent (2) | 0.100 |
| | | Reducing agent (1) | 0.016 |
| | | Fog inhibitor (4) | 0.004 |
| | | Anionic surface active agent (2) | 0.007 |
| | | Gelatin | 0.297 |
| | | Fog inhibitor (6) | 0.0004 |
| | | Water-soluble polymer (1) | 0.007 |
| 4th layer | Interlayer | Hardener (1) | 0.058 |
| | | Gelatin | 0.629 |
| | | Anionic surface active agent (1) | 0.009 |
| | | Nonionic surface active agent (2) | 0.046 |
| | | Water-soluble polymer (1) | 0.012 |
| 3rd layer | Near infrared-senstive layer (750 nm) | Emulsion (8) | 0.211 as silver |
| | | Cyan dye-providing compound (3) | 0.132 |
| | | Cyan dye-providing compound (4) | 0.1983 |
| | | High boiling solvent (5) | 0.178 |
| | | Reducing agent (1) | 0.018 |
| | | Fog inhibitor (4) | 0.005 |
| | | Anionic surface active agent (2) | 0.007 |
| | | Gelatin | 0.284 |
| | | Fog inhibitor (5) | 0.0003 |
| | | Stabilizer (1) | 0.0043 |
| | | Water-soluble polymer (1) | 0.010 |
| 2nd layer | Interlayer | Gelatin | 0.629 |
| | | Anionic surface active agent (1) | 0.006 |
| | | Nonionic surface active agent (2) | 0.057 |
| | | Water-soluble polymer (1) | 0.009 |
| 1st layer | Near infrared-sensitive layer (810 nm) | Emulsion (9) | 0.215 as silver |
| | | Fog inhibitor (5) | $8.4 \times 10^{-4}$ |
| | | Yellow dye-providing compound (2) | 0.429 |
| | | Dye (1) | 0.049 |
| | | High boiling solvent (5) | 0.172 |
| | | Reducing agent (1) | 0.023 |
| | | Fog inhibitor (4) | 0.003 |
| | Near infrared-sensitive layer | Anionic surface active agent (2) | 0.034 |
| | | Gelatin | 0.338 |
| | | Stabilizer (1) | 0.0054 |
| | | Water-soluble polymer (1) | 0.014 |

Support (1) Paper support laiminated with polyethylene (thickness: 131 μm)

Reducing agent (1)

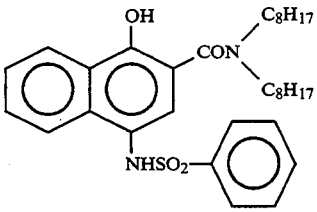

Fog inhibitor (4)

TABLE 22-continued

Constitution of photographic light-sensitive material D201

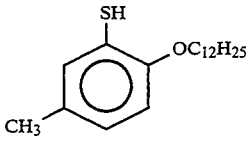

Fog inhibitor (5)

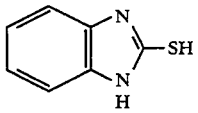

Fog inhibitor (6)

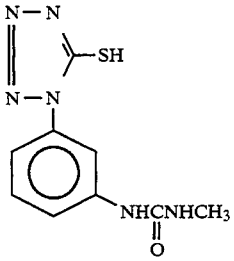

Nonionic surface active agent (2)

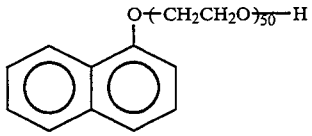

Stabilizer (1)

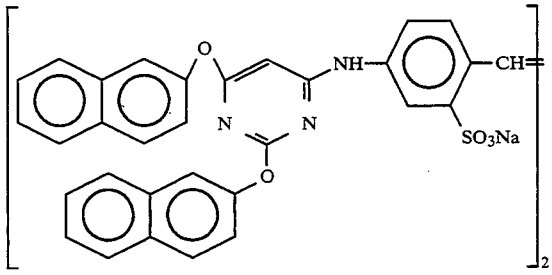

Dye (1)

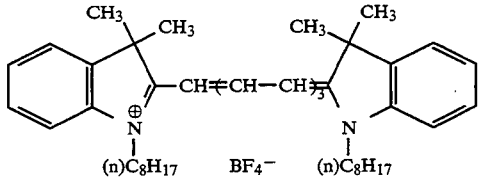

The high boiling solvent (5) is triisononylphosphate.

A process for the preparation of a dispersion of zinc hydroxide will be described below.

12.5 g of zinc hydroxide grains having an average grain size of 0.15 μm, 1 g of carboxylmethyl cellulose as a dispersant, and 0.1 g of sodium polyacrylate were added to 100 ml of a 4% aqueous solution of gelatin. The mixture was ground with glass beads having an average grain diameter of 0.75mm by means of a mill for 30 minutes. The glass beads were then removed from the mixture to obtain a dispersion of zinc hydroxide.

The following exposure and processing were effected to make evaluation.

The foregoing photographic light-sensitive material D201 and the image-receiving materials R201 to 220 prepared in Example 1 were then subjected to evaluation. The photographic light-sensitive material D201 was exposed to light by means of a laser exposure apparatus as described in JP-A-2-54672 under the conditions set forth in Table 23. The photographic light-sensitive material D201 thus exposed was supplied with wetting water on the surface of the emulsion layer through a wire bar. The photographic light-sensitive material D201 was then laminated with the image-receiving materials, respectively, in such an arrangement that the emulsion layer thereof were brought into contact with each other. The photographic light-sensitive material was then heated for 30 secnds over a heat roller which had been adjusted so that the temperature of the water-absorbed emulsion layer reached 85° C. Thereafter, the image-receiving material was peeled off the photographic light-sensitive material to form an image on the image-receiving material.

TABLE 23

| | |
|---|---|
| Beam intensity on the surface of the photographic light-sensitive material | 1 mV |
| Scanning line density | 800 dpi (32 rasters per mm) |
| Beam diameter | 100 ± 10 μm (in the direction of primary scanning)<br>80 ± 10 μm (in the direction of secondary scanning |
| Exposure time | 0.9 msec. per raster |
| Exposure wavelength | 670, 750, 810 nm (laser) |

TABLE 23-continued

| | |
|---|---|
| Exposure | 1 logE per 2.5 cm in the direction of secondary scanning<br>Variation (max. 80 erg /cm$^2$; min. 1.2 erg /cm$^2$) |
| Method for varying exposure | Light emission time modulation |

A black print having a uniform density was obtained by controlling the intensity of lasers from the foregoing exposure apparatus. The image thus obtained was evaluated in the same manner as in Example 1. The results are set forth in Table C.

TABLE C

| Image-receiving material | Matting agent (average grain diameter) | Incorporated in | Added amount (g/m$^2$) | Thickness/ grain diameter | Gloss | Transfer density | Texture | Transferability |
|---|---|---|---|---|---|---|---|---|
| 201(comparative) | — (—) | — | — | — | 85 | 2.31 | O | O |
| 202(comparative) | PMMA (6 μm) | 4th layer | 0.10 | — | 34 | 2.04 | O | O |
| 203(comparative) | PMMA (6 μm) | 4th layer | 0.20 | — | 21 | 1.90 | O | Δ |
| 204(comparative) | PMMA (6 μm) | 4th layer | 0.30 | — | 10 | 1.79 | x | Δ |
| 205(comparative) | PMMA (6 μm) | 4th layer | 0.50 | — | 8 | 1.70 | x | x |
| 206(comparative) | Benzoguanamine resin (17 μm) | 4th layer | 0.10 | — | 22 | 1.84 | x | Δ |
| 207(comparative) | Benzoguanamine resin (17 μm) | 4th layer | 0.20 | — | 13 | 1.71 | x | x |
| 208(present invention) | PMMA (1 μm) | 1st layer | 1.20 | 1.40 | 15 | 2.05 | O | O |
| 209(present invention) | PMMA (3 μm) | 1st layer | 0.90 | 0.30 | 15 | 2.04 | O | O |
| 210(present invention) | PMMA (10 μm) | 1st layer | 0.60 | 0.08 | 12 | 1.99 | O | Δ |
| 211(present invention) | PMMA (4 μm) | 1st layer | 1.20 | 0.35 | 9 | 1.96 | O | O |
| 212(present invention) | PMMA (6 μm) | 1st layer | 0.90 | 0.18 | 12 | 1.97 | O | O |
| 213(present invention) | PMMA (10 μm) | 1st layer | 0.90 | 0.11 | 10 | 1.96 | O | O |
| 214(present invention) | PMMA (6 μm) | 1st layer | 1.20 | 0.23 | 8 | 1.98 | O | O |
| 215(present invention) | Silicon dioxide (3 μm) | 1st layer | 0.90 | 0.37 | 12 | 1.99 | O | O |
| 216(present invention) | Silicon dioxide (6 μm) | 1st layer | 1.20 | 0.23 | 9 | 1.94 | O | O |
| 217(present invention) | Silicon dioxide (3 μm) | 1st layer | 0.90 | 0.60 | 13 | 1.97 | O | O |
| 218(present invention) | PMMA (4 μm) | 1st layer | 1.20 | 0.53 | 13 | 1.98 | O | O |
| 219(present invention) | Benzoguanamine resin (17 μm) | 1st layer | 0.90 | 0.11 | 9 | 2.00 | O | Δ |
| 220(present invention | Benzoguanamine resin (17 μm) | 1st layer | 1.50 | 0.10 | 8 | 1.93 | O | Δ |

As can be seen in Table C, the dye fixing materials comprising compounds according to the present invention satisfy the requirement for matte surface, i.e., low gloss, texture that prevents the surface from being seen covered white, and uniformity in transferred image as compared with Comparative Examples 201 to 207. In some detail, Comparative Examples 201 to 207, which are examples of the structure comprising a matting agent in the surface protective layer, exhibit a decreasing gloss and provide a better matte surface with the increase in the added amount of the matting agent. It can also be seen that the great the grain diameter of the matting agent used is, the less is the added amount required to provide good matte properties. However, it can be seen at the same time that the greater the added amount of the matting agent is, the worse is transferability and hence image uniformity. It can also be seen that R204 to 207, which are examples of the structure comprising a matting agent in the surface protective layer, exhibit a deteriorated texture as well. On the other hand, it can be seen that R208 to R220, which are examples of the structure according to the present invention comprising a matting agent in a layer (1st layer) nearer to the support than the mordant layer, provide a good matte surface without deteriorating texture and transferability. Among these specimens, R208 and R209, which comprise matting agents having a grain diameter of less than 4 μm, exhibit a slightly high gloss and hence reduced matte properties. On the contrary, R219 and R220, which comprise matting agents having a grain diameter of more than 15 μm, exhibit a slightly worse transferability. It can also be seen that R210, which has a thickness/grain diameter of less than 1/10, exhibits a slightly worse transferability. On the other hand, R217 and R218, which comprise a thickness/grain diameter of more than ½, exhibit a slightly increased gloss.

EXAMPLE 4

A process for the preparation of a dye fixing element will be given below.

A process for the preparation of a dispersion of fluorosecent brightening agent and stain inhibitor will be given below.

25 g of the foregoing fluorescent brightening agent (1), 32 g of the foregoing stain inhibitor (1), and 10 g of the foregoing anionic surface active agent (3) were dissolved in a mixture of 690 g of the foregoing high boiling organic solvent (5) and 250 ml of ethyl acetate. The solution was then mixed with 1,200 ml of a 25% aqueous solution of gelatin. The mixture was then subjected to dispersion at 1,250 rpm by means of a homogenizer. To the dispersion was then added 300 ml of water with stirring to obtain a homogeneous dispersion.

A process for the preparation of a latex dispersion will be then described. This latex polymer doesn't correspond to the matting agent defined herein.

20 g of gelatin and 30 g of the foregoing water-soluble polymer (4) were dissolved in 200 ml of water at a temperature of 50° C. The solution was then allowed to cool to temperature of 40° C. where 117 g of the foregoing polymer latex (3) was then added thereto with stirring. The dispersion was then filtered through a 30-μm filter in the form of solution to obtain a homogenous dispersion.

A dye fixing element R301 having the constitution set forth in Table 24.

TABLE 24 constitution of image-receiving material R101

| Layer No. | Additive | Coated amount (mg/m²) |
|---|---|---|
| 4th layer | Water-soluble polymer (2) | 200 |
| | Water-soluble polymer (3) | 60 |
| | Potassium nitrate | 30 |
| | Anionic surface active agent (1) | 8 |
| | Anionic surface active agent (3) | 7 |
| | Matting agent (2) | 10 |
| 3rd layer | Gelatin | 250 |
| | Water-soluble polymer (2) | 30 |
| | Amphoteric surface active agent (4) | 27 |
| | Hardener (2) | 190 |
| 2nd layer | Gelatin | 1,400 |
| | Water-soluble polymer (2) | 130 |
| | Water-soluble polymer (4) | 660 |
| | Polymer latex (3) | 1,180 |
| | High boiling solvent (3) | 690 |
| | Fluorescent brightening agent (1) | 25 |
| | Mordant (1) | 2,350 |
| | Anionic surface active agent (2) | 10 |
| | Guanidine picolate | 2,900 |
| | Stain inhibitor (1) | 32 |
| 1st layer | Gelatin | 190 |

TABLE 24-continued constitution of image-receiving material R101

| Layer No. | Additive | Coated amount (mg/m²) |
|---|---|---|
| | Water-soluble polymer (2) | 10 |
| | Anionic surface active agent (1) | 10 |
| | Amphoteric surface active agent (4) | 27 |
| | Hardener (2) | 190 |
| Support (1) | Paper support laminated with polyethylene (thickness: 206 μm) | |

Fluorescent brightening agent (1)

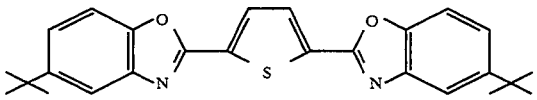

TABLE 25

Support (1)

| Layer name | Composition | Layer thickness (μm) |
|---|---|---|
| Surface PE layer | Gelatin | 0.1 |
| Surface PE layer (glossy) | Low density polyethylene (density: 0.923): 89.2 parts Surface-treated titanium oxide: 10.0 parts Ultramarine: 0.8 parts | 35.0 |
| Pulp layer | Woodfree paper (LBKP/NBKP = 1/1; density: 1.080) | 140.8 |
| Back PE layer (matte) | High density polyethylene (density: 0.960) | 30.0 |
| Back undercoating layer | Gelatin | 0.05 |
| | Colloidal silica | 0.05 |
| | | 206.0 |

Dye fixing elements R302 to R327 were prepared in the same manner as R301 except that the matting agents set forth in Table D were incorporated in the layers specified in Table D in an amount set forth in Table D, respectively. In R302 to R305, a polymethyl methacrylate (PMMA) was incorporated in the dye fixing element, i.e., layer different from R301 in an amount different from R301. Thus, R302 to R305 are not dye fixing elements according to the present invention. In R306 to R310, PMMA having different grain diameters were coated on the 3rd layer in the dye fixing element in the same amount. Thus, R306 to R310 are dye fixing elements according to the present invention. In R311 to R316, the coated amount of matting agent in the 3rd layer increases as the designation number goes up. All these specimens are dye fixing elements according to the present invention. In R317 to R320, the grain diameter and coated amount of PMMA are the same but the ratio of the thickness of coat layer to the grain diameter of PMMA increases as the designation number goes up. All these specimens are dye fixing elements according to the present invention. R321 to R327 comprise a matting agent in other layers as well. All these specimens are dye fixing elements according to the present invention.

The kind of the matting agents is represented by the kind of the material of the matting agent and the average grain diameter of the matting agent determined when it is in the form of starting material. This matting agent was confirmed under microscope to remain unagglomerated in the layer after coating. The layer in which the matting agent is incorporated is represented by the name of layer as set forth in Table 24. The amount of the matting agent to be incorporated is represented by gram as calculated in terms of solid content per $m^2$. Referring to the matting agent incorporated in the 3rd layer, the ratio of the thickness of the 3rd layer to the average grain diameter of the matting agent is represented by "thickness/grain diameter" in the table.

The foregoing dye fixing elements were then combined with a light-sensitive element commercially available from Fuji Photo Film Co., Ltd. as a trade name "PICTRO STAT 200 PS DONOR PS-DS". Using a color copy machine commercially available from the same manufacturer as a trade name "PICTRO STAT 200", a test image was obtained.

In some detail, the photographic light-sensitive material specimens were each subjected through a slit to scanning exposure to a full color original. The photographic light-sensitive material specimens thus exposed were each dipped in water kept at a temperature of 40° C. for 2.5 seconds, squeezed between rollers, and then immediately laminated on the image-receiving material in such an arrangement that the emulsion side thereof were brought into contact with each other. The laminate was then heated for 17 seconds over a heat drum which had been adjusted such that the temperature of the water-absorbed emulsion surface thereof reached 80° C. Subsequently, the photographic light-sensitive material was peeled off the image-receiving material. As a result, a sharp color image corresponding to the original was formed on the image-receiving material.

The gloss of the image was then measured by means of a digital gonioglossmeter UGV-5D available from Suga Shikenki K.K. The results (gloss at 20°) are set forth in Table D. When the gloss is less than 15, non-gloss surface is given. When the gloss is not more than 6, a so-called deep matte (glossless surface) is given.

The dark area on the image was then measured for the density by means of a reflective densitometer. The results are set forth in the tables as transfer density. Further, a visual evaluation was made on texture by which the image is seen as if it is covered white. The mark "x" indicates the condition under which the image is shown as if it is covered white. The mark "O" indicates an excellent condition.

Moreover, a visual evaluation was made on the uniformity in the transferred image. The results are set forth in the tables as "transferability". The mark "O" indicates the condition under which the image is seen without any white spots. The mark "Δ" indicates the condition under which the image shows white spots that can be recognized when strictly observed but cannot be visually recognized. The mark "x" indicates the condition under which the image certainly has white spots.

Further, a so-called feeling of glare on the surface of the image was evaluated. The results are set forth in the table as "glare". The mark "O" indicates the condition under which the image surface gives little irregular reflection of light from the light source, providing a good matte surface. The mark "x" indicates the condition under which glare is felt. The mark "Δ" indicates the intermediate condition between "O" and "x".

TABLE D

| Image-receiving material | Matting agent (average grain diameter) | Incorporated in | Added amount ($g/m^2$) | Thickness/ grain diameter | Gloss | Transfer density | Texture | Transfer-ability | Glare |
|---|---|---|---|---|---|---|---|---|---|
| 301(comparative) | — (—) | — | — | — | 76 | 2.28 | O | O | — |
| 302(comparative) | PMMA (4 μm) | 4th layer | 0.70 | — | 6 | 1.92 | Δ | Δ | O |
| 303(comparative) | PMMA (4 μm) | 4th layer | 1.20 | — | 3 | 1.70 | x | x | O |
| 304(comparative) | PMMA (4 μm) | 1st layer | 0.70 | — | 18 | 2.26 | O | O | x |
| 305(comparative) | PMMA (4 μm) | 1st layer | 1.20 | — | 10 | 2.21 | O | Δ | Δ |
| 306(present invention) | PMMA (1 μm) | 3rd layer | 0.70 | 1.20 | 28 | 2.15 | O | O | O |
| 307(present invention) | PMMA (4 μm) | 3rd layer | 0.70 | 0.30 | 11 | 2.08 | O | O | O |
| 308(present invention) | PMMA (8 μm) | 3rd layer | 0.70 | 0.15 | 10 | 2.03 | O | O | O |
| 309(present invention) | PMMA (12 μm) | 3rd layer | 0.70 | 0.10 | 8 | 2.05 | O | O | O |
| 310(comparative) | PMMA (16 μm) | 3rd layer | 0.70 | 0.075 | 5 | 2.00 | O | Δ | O |
| 311(present invention) | PMMA (4 μm) | 3rd layer | 0.05 | 0.14 | 32 | 2.25 | O | O | O |
| 312(present invention) | PMMA (4 μm) | 3rd layer | 0.20 | 0.15 | 25 | 2.21 | O | O | O |
| 313(present invention) | PMMA (4 μm) | 3rd layer | 1.00 | 0.30 | 8 | 2.12 | O | O | O |
| 314(present invention) | PMMA (4 μm) | 3rd layer | 1.50 | 0.50 | 7 | 2.06 | O | O | O |
| 315(present invention) | PMMA (4 μm) | 3rd layer | 2.50 | 0.75 | 7 | 2.00 | Δ | Δ | O |
| 316(present invention) | PMMA (4 μm) | 3rd layer | 3.50 | 1.00 | 6 | 1.96 | x | x | O |
| 317(present invention) | PMMA (4 μm) | 3rd layer | 0.70 | 0.05 | 9 | 2.08 | Δ | O | O |
| 318(present invention) | PMMA (4 μm) | 3rd layer | 0.70 | 0.2 | 10 | 2.11 | O | O | O |
| 319(present invention) | PMMA (4 μm) | 3rd layer | 0.70 | 0.4 | 11 | 2.06 | O | O | O |
| 320(present invention) | PMMA (4 μm) | 3rd layer | 0.70 | 0.6 | 13 | 2.10 | O | O | O |
| 321(present invention) | PMMA (4 μm)<br>PMMA (4 μm) | 3rd layer<br>1st layer | 0.70<br>1.50 | 0.30<br>0.50 | 1.3 | 1.96 | O | O | O |
| 322(present invention) | PMMA (4 μm)<br>PMMA (4 μm) | 3rd layer<br>1st layer | 0.70<br>1.00 | 0.30<br>0.375 | 1.98 | 1.98 | O | O | O |
| 323(present invention) | PMMA (4 μm)<br>PMMA (4 μm) | 3rd layer<br>1st layer | 0.70<br>0.50 | 0.30<br>0.25 | 7.0 | 2.02 | O | O | O |
| 324(present | PMMA (4 μm) | 3rd layer | 0.70 | 0.30 | 9.2 | 2.05 | O | O | O |

TABLE D-continued

| Image-receiving material | Matting agent (average grain diameter) | Incorporated in | Added amount ($g/m^2$) | Thickness/ grain diameter | Gloss | Transfer density | Texture | Transfer-ability | Glare |
|---|---|---|---|---|---|---|---|---|---|
| invention) | PMMA (4 μm) | 1st layer | 0.20 | 0.175 | | | | | |
| 325(present | PMMA (10 μm) | 3rd layer | 0.30 | 0.08 | 8.3 | 2.10 | O | O | O |
| invention) | PMMA (4 μm) | 1st layer | 0.70 | 0.30 | | | | | |
| 326(present | PMMA (4 μm) | 3rd layer | 0.70 | 0.30 | 6.4 | 2.07 | O | O | O |
| invention) | PMMA (4 μm) | 2nd layer | 0.70 | 0.30 | | | | | |
| 327(present | PMMA (4 μm) | 3rd layer | 0.70 | 0.30 | 6.1 | 2.05 | Δ | Δ | O |
| invention) | PMMA (8 μm) | 1st layer | 0.70 | 0.15 | | | | | |

As can be seen in Table D, the dye fixing materials comprising compounds according to the present invention satisfy the requirement for matte surface, i.e., low gloss, texture that prevents the surface from being seen covered white, difficulty for white spot in occurring on the transferred image, and feeling of glare on the image surface as compared with Comparative Examples R301 to R305. In some detail, Comparative Examples R302 to R303, which are examples of the structure comprising a matting agent in the surface protective layer, are more liable to be seen as if it is covered by a white powder, showing white spots thereon with the increase in the added amount of the matting agent. It can also be seen that Comparative Examples R304 and R305, which are examples of the structure comprising a matting agent between the support and the dye fixing layer, cannot prevent themselves from giving a feeling of glare unless the added amount of the matting agent is increased. However, these specimens show white spots on the image when the added amount of the matting agent is increased. On the other hand, it can be seen that R306 to R327, which are examples of the structure according to the present invention comprising a matting agent in a layer (3rd layer) which is disposed on the side of the support opposite the mordant layer (dye fixing layer) and which is not a surface protective layer, can provide a good matte surface and, when the added amount of the matting agent is in the preferred range, R306 to R327 can provide good texture and transferability. Among these specimens, R306, which comprises a matting agent having a small grain diameter, and R311, which comprises a slightly less amount of a matting agent, exhibit a slightly high gloss and hence reduced matte properties. On the contrary, R310, which comprises a matting agent having a grain diameter of more than 15 μm, shows white spots on the image. It can also be seen that R316, which comprises a matting agent in extremely large amount, and specimens which comprise a matting agent having a large grain diameter as compared with the layer thickness are seen as if they are covered by a white powder.

EXAMPLE 5

The dye fixing elements R301 to R327 as prepared in Example 4 were each combined with a light-sensitive material commercially available from Fuji Photo Film Co., Ltd. as a trade name "PICTRGRAPHY 3000 PG-DONOR PG-D". Using a printer commercially available from the same manufacturer as a trade name "PICTRO GRAPHY 3000", a black print having a uniform density was obtained.

This image was then evaluated in the same manner as in Example 4. The results were the same as shown in Table D.

As has been described, the use of the dye fixing element according to the present invention can provide a good matte image that satisfies the requirements for matte surface, i.e., low gloss, texture that prevents the image from being seen white, difficulty for white spot in occurring on the transferred image, and surface condition that gives no glare.

While the invention has been described in detail and with reference to specific embodiments thereof, it will be apparent to one skilled in the art that various changes and modifications can be made therein without departing from the spirit and scope thereof.

What is claimed is:

1. A dye fixing element for use in an image formation system which is adapted to superimpose a light-sensitive element and a dye fixing element provided on separate supports upon each other so that diffusible dyes are transferred to said dye fixing element to form an image, wherein a matting agent consisting of inorganic compound grains or organic compound grains is incorporated in either a layer nearer to said support than a dye fixing layer in said dye fixing element or a layer provided between said dye fixing layer and a surface protective layer.

2. The dye fixing element according to claim 1, wherein said matting agent to be incorporated has an essential average grain diameter in a range of from 2 μm to 15 μm.

3. The dye fixing element according to claim 1, wherein the amount of said matting agent to be coated in said matting agent-containing layer is in a range of from 0.1 $g/m^2$ to 3 $g/m^2$.

4. The dye fixing element according to claim 1, wherein the thickness of said matting agent-containing layer is in a range of from 1/10 to ½ of the average grain diameter of the matting agent.

5. The dye fixing element according to claim 1, wherein said matting agent is further incorporated in a layer disposed between said dye fixing layer and its support.

* * * * *